US012660901B2

(12) United States Patent
Cochran et al.

(10) Patent No.: US 12,660,901 B2
(45) Date of Patent: Jun. 23, 2026

(54) RESEALABLE CLOSURE FOR A CONTAINER

(71) Applicant: YETI Coolers, LLC, Austin, TX (US)

(72) Inventors: Isabelle Cochran, Austin, TX (US); John Warren Dow, Austin, TX (US); Andy Bondhus, Austin, TX (US); Mark D. Miller, San Marcos, TX (US); William Drinkwater, Austin, TX (US); Xi Huang, Xiamen (CN); Quan Xiao, Xiamen (CN); Fuzhen Lai, Xiamen (CN)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/628,397

(22) Filed: Apr. 5, 2024

(65) Prior Publication Data

US 2025/0057294 A1 Feb. 20, 2025

Related U.S. Application Data

(63) Continuation of application No. PCT/CN2023/113021, filed on Aug. 15, 2023.

(51) Int. Cl.
*A45C 13/10* (2006.01)
*A45C 11/20* (2006.01)
(Continued)

(52) U.S. Cl.
CPC ..... *A45C 13/1069* (2013.01); *A45C 11/20* (2013.01); *A45C 13/008* (2013.01);
(Continued)

(58) Field of Classification Search
CPC ... A45C 13/1069; A45C 11/20; A45C 13/008; B65D 33/105; B65D 33/24; B65D 81/3897
(Continued)

(56) References Cited

U.S. PATENT DOCUMENTS 2,389,298 A * 11/1945 Ellis ..... A41F 1/002 211/DIG. 1
2,627,097 A 2/1953 Ellis
(Continued)

FOREIGN PATENT DOCUMENTS

CA 2799530 C 8/2018
CH 686058 A5 12/1995
(Continued)

OTHER PUBLICATIONS

Nov. 9, 2023—(WO) International Search Report & Written Opinion—PCT/CN2023/113021.
(Continued)

*Primary Examiner* — Nathan J Newhouse
(74) *Attorney, Agent, or Firm* — Banner & Witcoff, Ltd.

(57) ABSTRACT

A container device may have an outer shell that has an opening that is sealed by a closure mechanism. The closure mechanism may include resealable closure elements that are configured to partially or wholly seal the opening. In some examples, the closure elements may include magnetic strips that are formed with a first member, a second member, and a plurality of magnetic elements. In addition, the closure mechanism may include curved members to prevent the opening from closing when the closure mechanism is in an open configuration.

20 Claims, 14 Drawing Sheets

(51) Int. Cl.

| | |
|---|---|
| ***A45C 13/00*** | (2006.01) |
| ***B65D 33/10*** | (2006.01) |
| ***B65D 33/24*** | (2006.01) |
| ***B65D 81/38*** | (2006.01) |

(52) U.S. Cl.
CPC ..... *B65D 33/105* (2013.01); *B65D 33/24* (2013.01); *B65D 81/3897* (2013.01)

(58) Field of Classification Search
USPC ..... 383/95
See application file for complete search history.

(56) References Cited

U.S. PATENT DOCUMENTS

| | | | | |
|---|---|---|---|---|
| 2,784,757 | A | 3/1957 | Requa | |
| 3,102,314 | A | 9/1963 | Alderfer | |
| 3,111,735 | A | 11/1963 | Ellis | |
| 3,161,932 | A | 12/1964 | Russell | |
| 3,665,355 | A | 5/1972 | Sasaki et al. | |
| 3,827,019 | A | 7/1974 | Serbu | |
| 3,919,743 | A | 11/1975 | Cutler | |
| 4,033,013 | A | 7/1977 | Peterson | |
| 4,197,618 | A | 4/1980 | Bourguignon | |
| 4,236,331 | A | 12/1980 | Mattson | |
| 4,255,837 | A | 3/1981 | Holtz | |
| 4,258,493 | A | 3/1981 | Kettlestrings et al. | |
| 4,399,595 | A | 8/1983 | Yoon et al. | |
| 4,531,560 | A | 7/1985 | Balanky | |
| 4,656,697 | A | 4/1987 | Naslund | |
| 4,738,390 | A | 4/1988 | Brennan | |
| 5,148,580 | A | 9/1992 | Dyckow | |
| 5,196,818 | A | 3/1993 | Anderson | |
| 5,354,462 | A | 10/1994 | Perritt | |
| 5,422,156 | A | 6/1995 | Billarant | |
| 5,450,658 | A | 9/1995 | Hicks | |
| 5,505,305 | A | 4/1996 | Scholz et al. | |
| 5,524,689 | A | 6/1996 | Clark | |
| 5,604,960 | A | 2/1997 | Good | |
| 5,647,101 | A | 7/1997 | Morita | |
| 5,682,653 | A | 11/1997 | Berglof et al. | |
| 5,687,848 | A | 11/1997 | Scholz et al. | |
| 5,746,638 | A | 5/1998 | Shiraishi | |
| 6,062,528 | A | 5/2000 | Beck et al. | |
| 6,101,688 | A | 8/2000 | Marchesi | |
| 6,226,842 | B1 | 5/2001 | Wong | |
| 6,292,985 | B1 | 9/2001 | Grunberger | |
| 6,301,754 | B1 | 10/2001 | Grunberger et al. | |
| 6,378,174 | B1 | 4/2002 | Wong | |
| 6,412,116 | B1 | 7/2002 | Clark | |
| 6,428,869 | B1 | 8/2002 | Ozgen et al. | |
| 6,434,801 | B2 | 8/2002 | Grunberger | |
| 6,468,624 | B1 | 10/2002 | Fujisawa et al. | |
| 6,505,385 | B2 | 1/2003 | Grunberger | |
| 6,779,199 | B1 | 8/2004 | O'Dea et al. | |
| 6,954,968 | B1 | 10/2005 | Sitbon | |
| 7,033,657 | B2 | 4/2006 | Martin | |
| 7,187,261 | B2 | 3/2007 | Cassar | |
| 7,986,206 | B2 | 7/2011 | Maddocks et al. | |
| 8,098,122 | B2 | 1/2012 | Fullerton et al. | |
| 8,316,515 | B2 | 11/2012 | Slank | |
| 8,368,494 | B2 | 2/2013 | Fiedler | |
| 8,851,534 | B2 | 10/2014 | Fiedler | |
| 8,997,318 | B2 | 4/2015 | Nicolas et al. | |
| 9,392,829 | B2 | 7/2016 | Manuello | |
| 9,572,386 | B1 | 2/2017 | Scheer et al. | |
| 9,668,560 | B2 | 6/2017 | Lenci et al. | |
| 9,704,419 | B2 | 7/2017 | Medley | |
| 9,914,615 | B2 | 3/2018 | Wooldridge et al. | |
| 9,966,174 | B2 | 5/2018 | Naftali et al. | |
| 10,132,340 | B2 | 11/2018 | Russell-Clarke et al. | |
| 10,156,247 | B2 | 12/2018 | Pensak | |
| 10,244,806 | B2 | 4/2019 | Marks | |
| 10,503,216 | B2 | 12/2019 | Weldon et al. | |
| 10,506,895 | B2 | 12/2019 | Mogil et al. | |
| 10,533,592 | B2 | 1/2020 | Sutcliffe et al. | |
| 10,568,374 | B2 | 2/2020 | Klein-Kassab | |
| 10,586,641 | B2 | 3/2020 | Good | |
| 10,629,349 | B2 | 4/2020 | Naftali et al. | |
| 10,709,044 | B1 | 7/2020 | Judy | |
| 10,743,597 | B2 | 8/2020 | Tong | |
| 10,856,594 | B2 | 12/2020 | Smith, IV et al. | |
| 10,893,713 | B2 | 1/2021 | Popoca Perez | |
| 10,954,055 | B2 | 3/2021 | Rogers et al. | |
| 10,993,505 | B1 | 5/2021 | Boxberger | |
| 11,027,889 | B1 | 6/2021 | Western et al. | |
| 11,076,666 | B2 * | 8/2021 | Sullivan | A45C 13/008 |
| 11,133,122 | B2 | 9/2021 | Vazquez | |
| 11,166,532 | B2 | 11/2021 | Judy | |
| 11,185,117 | B2 | 11/2021 | Murphy et al. | |
| 11,198,541 | B2 | 12/2021 | Hochberg et al. | |
| 11,270,823 | B2 | 3/2022 | Naftali et al. | |
| 11,375,789 | B2 | 7/2022 | Weber | |
| 11,381,892 | B1 | 7/2022 | Scales et al. | |
| 11,600,418 | B2 | 3/2023 | Naftali et al. | |
| D984,277 | S | 4/2023 | Moalem et al. | |
| 11,992,104 | B2 * | 5/2024 | Sullivan | A45C 3/00 |
| 2001/0014998 | A1 | 8/2001 | Grunberger | |
| 2004/0165332 | A1 | 8/2004 | Beson | |
| 2004/0173484 | A1 | 9/2004 | Bates et al. | |
| 2004/0237266 | A1 | 12/2004 | Wang | |
| 2005/0097711 | A1 | 5/2005 | Halstead | |
| 2005/0145302 | A1 | 7/2005 | Mutterer et al. | |
| 2006/0006969 | A1 | 1/2006 | Cassar | |
| 2006/0016841 | A1 | 1/2006 | Shurm | |
| 2007/0277353 | A1 | 12/2007 | Kondo et al. | |
| 2008/0272872 | A1 | 11/2008 | Fiedler | |
| 2009/0151826 | A1 | 6/2009 | Baxter | |
| 2009/0283197 | A1 | 11/2009 | Gorodisher | |
| 2009/0307982 | A1 | 12/2009 | Romberg et al. | |
| 2010/0005633 | A1 | 1/2010 | Nolet | |
| 2010/0025442 | A1 | 2/2010 | Shurm | |
| 2010/0275419 | A1 | 11/2010 | Millus | |
| 2012/0128273 | A1 | 5/2012 | Lytle | |
| 2012/0216374 | A1 | 8/2012 | Manuello | |
| 2015/0196955 | A1 | 7/2015 | Naftalin | |
| 2015/0296910 | A1 | 10/2015 | Nelson et al. | |
| 2015/0364237 | A1 | 12/2015 | Mayfield | |
| 2016/0086708 | A1 | 3/2016 | Corbin et al. | |
| 2021/0074459 | A1 | 3/2021 | Ji | |
| 2021/0298399 | A1 | 9/2021 | Mckee et al. | |
| 2021/0300630 | A1 | 9/2021 | Browne et al. | |
| 2021/0392983 | A1 | 12/2021 | Lagalante | |
| 2022/0194666 | A1 | 6/2022 | Boudouris et al. | |
| 2023/0210236 | A1 | 7/2023 | Fiedler et al. | |
| 2023/0389680 | A1 | 12/2023 | Naftali et al. | |
| 2025/0082082 | A1 * | 3/2025 | Fiedler | A45F 3/005 |

FOREIGN PATENT DOCUMENTS

| | | | | |
|---|---|---|---|---|
| CN | 1308972 | C | 4/2007 | |
| CN | 200995999 | Y | 12/2007 | |
| CN | 101168090 | A | 4/2008 | |
| CN | 201393583 | Y | 2/2010 | |
| CN | 201465446 | U | 5/2010 | |
| CN | 103237473 | A | 8/2013 | |
| CN | 110381771 | A | 10/2019 | |
| CN | 113543675 | A | 10/2021 | |
| CN | 113613527 | A | 11/2021 | |
| CN | 216685557 | U | 6/2022 | |
| CN | 217125617 | U | 8/2022 | |
| DE | 1954497 | U | 2/1967 | |
| DE | 19821453 | C1 | 1/2000 | |
| DE | 202009000499 | U1 * | 3/2009 | B65D 33/24 |
| DE | 102013203440 | A1 | 8/2014 | |
| EP | 0922399 | A2 | 6/1999 | |
| EP | 1264553 | A1 | 12/2002 | |
| EP | 1529459 | A1 | 5/2005 | |
| EP | 1683736 | A2 | 7/2006 | |
| EP | 2301375 | A1 | 3/2011 | |
| EP | 1585398 | B1 | 5/2012 | |
| EP | 2066191 | B1 | 1/2016 | |
| EP | 2571391 | B1 | 2/2019 | |
| EP | 4188150 | B1 | 6/2024 | |

(56) References Cited

FOREIGN PATENT DOCUMENTS

| | | | | |
|---|---|---|---|---|
| FR | 2492238 | A1 | 4/1982 | |
| FR | 2402931 | B1 | 8/1982 | |
| FR | 2790373 | A1 | 9/2000 | |
| GB | 2355281 | A | 4/2001 | |
| IL | 205846 | A | 8/2016 | |
| JP | 58039009 | | 3/1983 | |
| JP | 62058606 | | 3/1987 | |
| JP | 1126956 | A | 5/1989 | |
| JP | 09068863 | | 12/1997 | |
| JP | 9328149 | | 12/1997 | |
| JP | 3160109 | B2 | 4/2001 | |
| JP | 2001267164 | A | 9/2001 | |
| JP | 2000382970 | | 5/2002 | |
| JP | 2003071978 | A | 3/2003 | |
| JP | 2006049519 | A | 2/2006 | |
| JP | 2005160642 | A | 12/2006 | |
| JP | 2005211083 | A | 2/2007 | |
| JP | 2010046152 | A | 3/2010 | |
| KR | 19990034004 | U | 8/1999 | |
| KR | 20020046244 | A | 6/2002 | |
| KR | 200341520 | Y1 | 2/2004 | |
| KR | 100729960 | B1 | 6/2007 | |
| KR | 20070089473 | A | 8/2007 | |
| KR | 10-2009-0094132 | A | 9/2009 | |
| KR | 20-0447735 | Y1 | 2/2010 | |
| TW | 00486938 | U | 5/2002 | |
| TW | M274349 | U | 9/2005 | |
| TW | 1283566 | B | 7/2007 | |
| TW | M339948 | U | 9/2008 | |
| TW | 200938442 | A | 9/2009 | |
| WO | 0108527 | A1 | 2/2001 | |
| WO | 2007140916 | A2 | 12/2007 | |
| WO | 08025905 | A2 | 3/2008 | |
| WO | 11037356 | A2 | 3/2011 | |
| WO | WO-2020181241 | A1 * | 9/2020 | ..... A45C 13/008 |
| WO | WO-2020181243 | A1 * | 9/2020 | ..... A45C 11/20 |
| WO | 2021228667 | A1 | 11/2021 | |
| WO | 2022200012 | A1 | 9/2022 | |
| WO | 2022200013 | A1 | 9/2022 | |
| WO | 24061992 | A1 | 3/2024 | |
| WO | 24061993 | A1 | 3/2024 | |

OTHER PUBLICATIONS thehackersparadise.com, "Converting a Putter Cover from Velcro to Magnetic Closure", published Jul. 9, 2009, retrieved on Dec. 22, 2025 from <https://www.thehackersparadise.com/converting-a-putter-cover-from-velcro-to-magnetic-closure/>, 9 pgs.

chriswdesigns.com, "How to Install a Sew-In Magnetic Snap Invisibly", Christine Welsh, published on Feb. 6, 2011, retrieved on Dec. 22, 2025 from <https://www.chriswdesigns.com/2011/how-to-install-a-sew-in-magnetic-snap-invisibly.html>, 9 pgs.

web.archive.org, "Sewing Magnets", K&J Magnetics, Inc., published on the Wayback Machine on Jan. 20, 2011, retrieved on Dec. 22, 2025 from <https://web.archive.org/web/20110120044343/https://www.kjmagnetics.com/blog.asp? p=sewing-magnets>, 5 pgs.

Mar. 3, 20261—(NZ) First Examination Report—App. No. 829790.

* cited by examiner

RESEALABLE CLOSURE FOR A CONTAINER

CROSS-REFERENCE TO RELATED APPLICATIONS

This application is a continuation of International Patent Application No. PCT/CN2023/113021 filed on Aug. 15, 2023. This application is incorporated herein by reference in its entirety for any and all non-limiting purposes.

This application is also related subject matter to U.S. application Ser. No. 16/295,682 filed Mar. 7, 2019, U.S. application Ser. No. 16/096,206 filed Oct. 24, 2018, PCT/US18/21546 filed Mar. 8, 2018, and U.S. Provisional Patent Application No. 62/468,673 filed Mar. 8, 2017. All of these applications are incorporated herein by reference in their entirety for any and all non-limiting purposes.

FIELD

The present disclosure relates generally to a magnetic closure useful for sealing items (e.g., personal belongings, electronics, food, drinks, and other gear) in the storage compartment of a non-rigid, semi-rigid, and rigid portable container, vessel, bag, or other storage device for the primary storage compartment or for a secondary storage compartment.

BACKGROUND

Containers may be designed to store a user's items (e.g., personal belongings, electronics, food, drinks) in order to provide a degree of protection from incidental impact (e.g., drops), as well as from liquids and dirt. Containers may be composed of rigid or flexible materials such as metal, plastics, fabric, or foams. Containers may be designed with an opening/aperture that allows access to the interior contents of the container. The opening may also be provided with a closure mechanism.

BRIEF SUMMARY

This Summary introduces some general concepts relating to this disclosure in a simplified form that are further described below in the Detailed Description. This Summary is not intended to identify key features or essential features of the disclosure.

Aspects of this disclosure herein may relate to container devices having one or more of (1) a partial or full waterproof closure and/or (2) a magnetic closure. In some examples, the container may also include a mechanism to keep the container open or closed.

Other aspects of this disclosure may relate to a container, comprising: (a) an outer shell defining a sidewall and a base, the outer shell having a front portion, a back portion, side portions, and a base portion; (b) an opening extending into a storage compartment, the opening having a front side and a back side; and (c) a closure mechanism. The closure mechanism may comprise (a) a first magnetic strip coupled to the front portion at the front side of the opening comprising: (1) a first non-metallic member with a first plurality of receivers in a first front surface, where each receiver includes a sidewall surface, a bottom surface, where the first non-metallic member further includes a first top surface, a first bottom surface opposite the first top surface, a first rear surface opposite the first front surface, and a first upper shelf member that extends beyond the first top surface, where the first upper shelf member connects to the first front surface forming an upper shelf surface extending between the first front surface of the first non-metallic member and a connection surface of the first upper shelf member, and where the connection surface is spaced apart a first predetermined distance from the first front surface; (2) a first plurality of magnetic elements, where each magnetic element of the first plurality of magnetic elements is received in a corresponding receiver of the first plurality of receivers; and (3) a second non-metallic member joined to the first non-metallic member, where the second non-metallic member covers the first plurality of magnetic elements that are within the first plurality of receivers of the first non-metallic member; where the second non-metallic member further comprises an upper surface that contacts the upper shelf surface of the first non-metallic member, a second front surface that contacts the first front surface of the first non-metallic member, and a second rear surface opposite the second front surface of the second non-metallic member that is substantially coplanar with the connection surface of the first upper shelf member of the first non-metallic member; and (b) a second magnetic strip coupled to the back portion at the back side of the opening comprising: (1) a third non-metallic member with a second plurality of receivers in a third front surface and a third rear surface opposite the third front surface; (2) a second plurality of magnetic elements, where each magnetic element of the second plurality of magnetic elements is received in a corresponding receiver of the second plurality of receivers; and (3) a fourth non-metallic member that covers the second plurality of magnetic elements that are within the second plurality of receivers of the third non-metallic member, where the fourth non-metallic member further comprises a fourth front surface that contacts the third front surface of the third non-metallic member. When the closure mechanism is in a closed configuration, the first rear surface of the first non-metallic member may contact the third rear surface of the third non-metallic member. The first plurality of receivers may be aligned in a linear orientation. Each receiver of the first plurality of receivers may include a slot along the sidewall surface, where the slot extends from the bottom surface to the first front surface. The first non-metallic member may include a lower shelf member, where a first engaging surface of the lower shelf member is spaced apart a second predetermined distance from the first front surface, where the first engaging surface is spaced below the first front surface and below the connection surface. The first non-metallic member may further comprise a lower shelf surface formed between the first front surface and the first engaging surface, where the lower shelf surface includes a plurality of recesses that extend toward the upper shelf surface, and where a peak of a first recess of the plurality of recesses is located in between two receivers of the first plurality of receivers. Additionally, the second non-metallic member may further comprise a second engaging surface that contacts the lower shelf surface of the first non-metallic member, where the second engaging surface includes a first projection that extends into the first recess, and where the first projection and the first recess have corresponding surfaces that fit together. In some examples, an upper surface of each magnetic element is spaced a third predetermined distance below the first front surface of the first non-metallic member. The second non-metallic member may also include a plurality of protrusions that extend from the second front surface of the second non-metallic member, and where each protrusion of the plurality of protrusions extends into a corresponding receiver of the first plurality of receivers. A portion of each protrusion of the plurality of protrusions may contact a corresponding magnetic element of the first plurality of magnetic elements located in the corresponding receiver. In addition, a portion of the connection surface of the first non-metallic member may connect to the front side of the opening.

Additional aspects of this disclosure may relate to a closure mechanism for an opening of a container that comprises: (a) a first magnetic strip coupled to a first side of the opening comprising: (1) a first non-metallic member with a first plurality of receivers in a first front surface, where each receiver includes a sidewall surface, a bottom surface, and where the first non-metallic member also includes a first top surface, a first bottom surface opposite the first top surface, and a first rear surface opposite the first front surface; (2) a first plurality of magnetic elements, where each magnetic element of the first plurality of magnetic elements is received in a corresponding receiver of the first plurality of receivers, and where an upper surface of each magnetic element of the first plurality of magnetic elements is spaced a first predetermined distance below the first front surface of the first non-metallic member; and (3) a second non-metallic member joined to the first non-metallic member, where the second non-metallic member covers the first plurality of magnetic elements that are within the first plurality of receivers of the first non-metallic member, and where the second non-metallic member further comprises a second front surface that contacts the first front surface of the first non-metallic member, a second rear surface opposite the second front surface of the second non-metallic member, and a plurality of protrusions that extend from the second front surface of the second non-metallic member, and where each protrusion of the plurality of protrusions extends into a corresponding receiver of the first plurality of receivers; and (b) a second magnetic strip coupled to a second side of the opening comprising: (1) a third non-metallic member with a second plurality of receivers in a third front surface and a third rear surface opposite the third front surface; (2) a second plurality of magnetic elements, where each magnetic element of the second plurality of magnetic elements is received in a corresponding receiver of the second plurality of receivers; and (3) a fourth non-metallic member that covers the second plurality of magnetic elements that are within the second plurality of receivers of the third non-metallic member, and where the fourth non-metallic member further comprises a fourth front surface that contacts the third front surface of the third non-metallic member. When the closure mechanism is in a closed configuration, the first rear surface of the first non-metallic member may contact the third rear surface of the third non-metallic member. A portion of each protrusion of the plurality of protrusions may contact a corresponding magnetic element of the first plurality of magnetic elements located in the corresponding receiver. Each receiver of the first plurality of receivers may include a slot along the sidewall surface, where the slot extends from the bottom surface to the first front surface. The first non-metallic member includes the first non-metallic member further including a lower shelf member, where a first engaging surface of the lower shelf member may be spaced apart a second predetermined distance from the first front surface, and where the first engaging surface may be spaced below the first front surface. In some examples, the first non-metallic member may further comprise a lower shelf surface formed between the first front surface and the first engaging surface, where the lower shelf surface may include a plurality of recesses that extend toward the first top surface, where a peak of a first recess of the plurality of recesses is located in between two receivers of the first plurality of receivers. The second non-metallic member may also comprise a second engaging surface that contacts the lower shelf surface of the first non-metallic member, where the second engaging surface includes a first projection that extends into the first recess, and where the first projection and the first recess have corresponding surfaces that fit together.

Yet other aspects of this disclosure may relate to a container, comprising: (a) an outer shell defining a sidewall and a base, the outer shell having a front portion, a back portion, side portions, and a base portion; (b) an opening extending into a storage compartment, the opening having a front side and a back side; and (c) a closure mechanism. The closure mechanism may comprise: (a) a first magnetic strip coupled to the front portion at the front side of the opening comprising: (1) a first member with a first plurality of receivers in a first front surface, where each receiver includes a sidewall surface, a bottom surface, and where the first member further includes a first top surface, a first bottom surface opposite the first top surface, a first rear surface opposite the first front surface, and a first lower shelf member, where a first engaging surface of the first lower shelf member is spaced a first predetermined distance away from and below the first front surface; and where the first member further comprises a lower shelf surface formed between the first front surface and the first engaging surface, where the lower shelf surface includes a plurality of recesses that extend toward the first top surface, where a peak of a first recess of the plurality of recesses is located in between two receivers of the first plurality of receivers; (2) a first plurality of magnetic elements, where each magnetic element of the first plurality of magnetic elements is received in a corresponding receiver of the first plurality of receivers, and (3) a second member joined to the first member, where the second member covers the first plurality of magnetic elements that are within the first plurality of receivers of the first member, and where the second member further comprises a second front surface that contacts the first front surface of the first member, a second rear surface opposite the second front surface of the second member; and (b) a second magnetic strip coupled to the back portion at the back side of the opening comprising: (1) a third member with a second plurality of receivers in a third front surface and a third rear surface opposite the third front surface; (2) a second plurality of magnetic elements, where each magnetic element of the second plurality of magnetic elements is received in a corresponding receiver of the second plurality of receivers; (3) a fourth member that covers the second plurality of magnetic elements that are within the second plurality of receivers of the third member, and where the fourth member further comprises a fourth front surface that contacts the third front surface of the third member. When the closure mechanism is in a closed configuration, the first rear surface of the first member contacts the third rear surface of the third member. The second member may further comprise a second engaging surface that contacts the lower shelf surface of the first member, where the second engaging surface that includes a first projection that extends into the first recess, where the first projection and the first recess have corresponding surfaces that fit together. An upper surface of each magnetic element may be spaced a third predetermined distance below the first front surface of the first member. The second member may further include a plurality of protrusions that extend from the second front surface of the second member, and where each protrusion of the plurality of protrusions may extend into a corresponding receiver of the first plurality of receivers. A portion of each protrusion of the plurality of protrusions may contact a corresponding magnetic element of the first plurality of magnetic elements located in the corresponding receiver.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Figure 1:
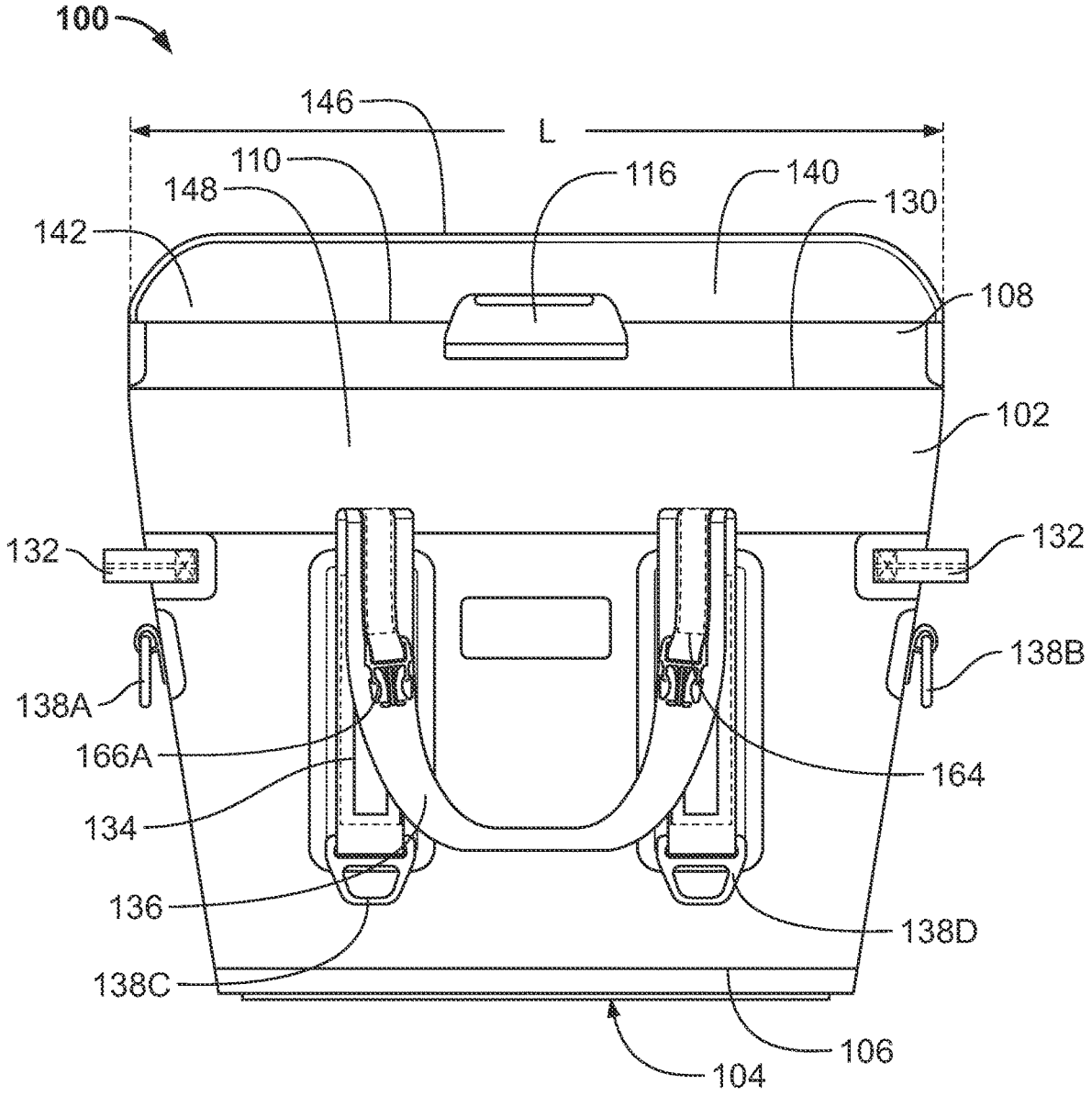
FIG. 1 depicts a front view an exemplary container that can be configured to keep contents cool or warm for an extended period of time, according to one or more aspects described herein.

Further, it is to be understood that the drawings may represent the scale of different components of various examples; however, the disclosed examples are not limited to that particular scale. Further, the drawings should not be interpreted as requiring a certain scale unless otherwise stated.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "front," "back," "top," "base," "bottom," "side," "forward," "rearward," "front-facing," and "rear-facing" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

The term "substantially aligned" as used herein may be defined as two items (i.e., edges, surfaces, or centerlines) being within a range of +/−4 mm of each other. In addition, the term "substantially parallel" as used herein may be defined as two items (i.e., edges, surfaces, or centerlines) being within a range of +/−5 degrees of each other.

In the description that follows, reference is made to one or more container structures. It is contemplated that any of the disclosed structures may be constructed from any polymeric, elastomeric, composite, and/or metal/alloy material, without departing from the scope of these disclosures. Additionally, it is contemplated that any manufacturing methodology may be utilized, without departing from the scope of these disclosures. For example, one or more welding (e.g., RF welding, heat welding, high frequency welding, ultrasonic welding, or laser welding of fabric, or metal/alloy welding), gluing, taping, stitching, molding, injection molding, blow molding, stamping, deep-drawing, casting, die-casting, drilling, deburring, grinding, polishing, sanding, heat pressing, or etching processes, among many others, may be utilized to construct of the various magnetic strips and containers described throughout these disclosures. Additionally, where reference is made to a magnetic element or structure throughout these disclosures, it may be assumed that the element or structure includes one or more magnets (e.g., permanent magnets), or one or more metals or alloys (e.g., ferromagnetic materials, among others), which may be attracted to magnets. Additionally, these magnetic elements may be constructed from any magnetic metal or alloy, and may be combined with one or more non-magnetic materials, such as polymers, ceramics, or non-magnetic metals or alloys. In some examples, the magnetic elements may be made of Neodymium, Neodymium Iron Boron, Samarium-Cobalt, rare-earth magnets, and other such magnetic material. It is also contemplated that the various disclosures described in this document may be combined in any manner, such that various permutations of combined elements may be possible.

Various magnetic closure mechanisms are described throughout the following disclosures. These magnetic closure mechanisms may be configured to create a seal that is partially or fully watertight, and/or airtight, and/or that partially or fully prevents dust or other materials from passing through the magnetic closure when sealed. It is contemplated that the magnetic closure mechanisms may include gaskets and seals in addition to the described magnetic elements, without departing from the scope of these disclosures.

It is contemplated that any of the containers discussed throughout this document may be partially or fully watertight, airtight, and/or sealed to substantially or fully prevent dust or other materials from entering into and/or escaping from the containers. For example, containers, which are described in this disclosure may include partially or fully water-resistant outer shells/outer walls and closure mechanisms.

Figure 2:
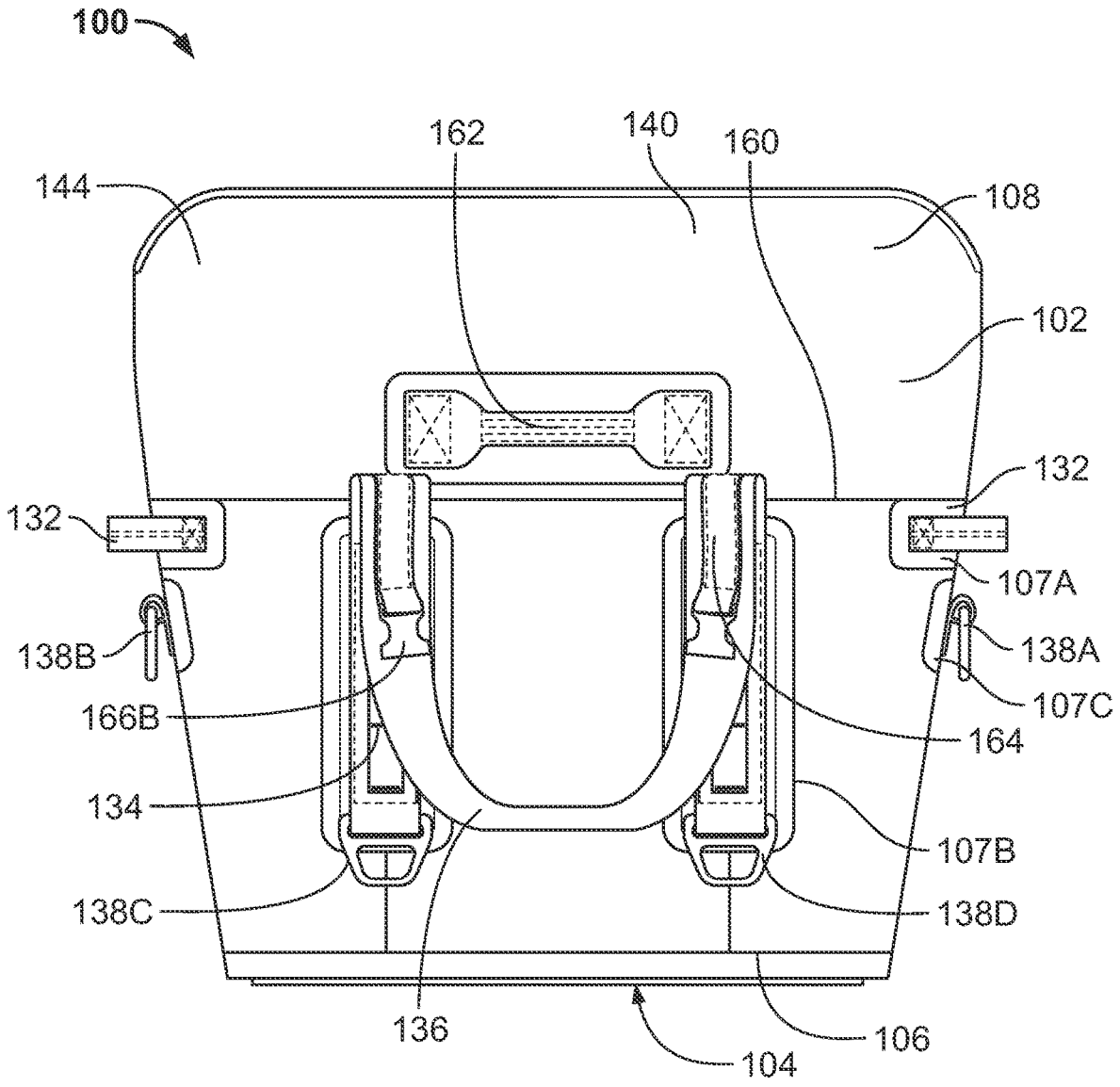
FIG. 2 depicts a back view of the exemplary container of FIG. 1, according to one or more aspects described herein.
Figure 4:
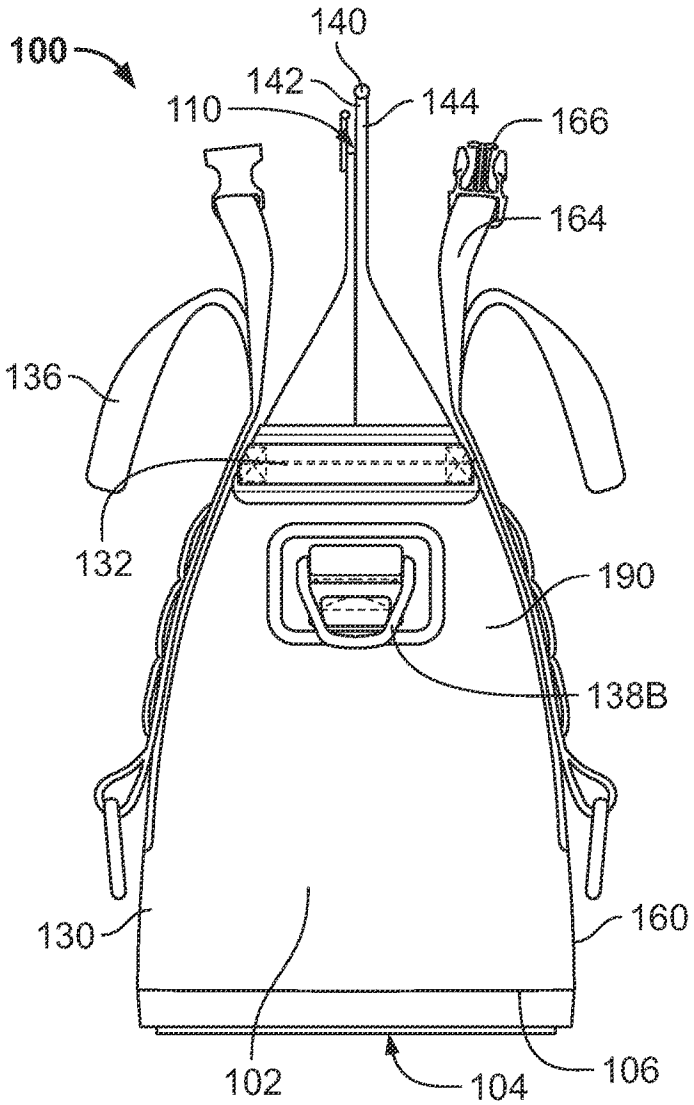
FIG. 4 depicts a right-side view of the exemplary container of FIG. 1, according to one or more aspects described herein.
Figure 3:
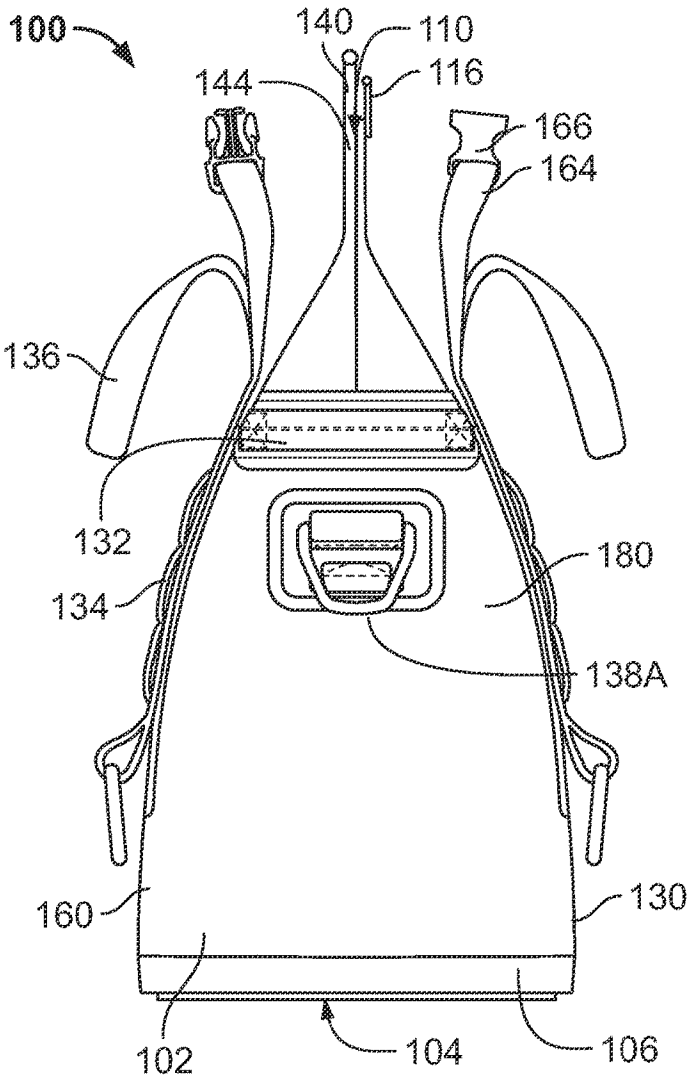
FIG. 3 depicts a left side view of the exemplary container of FIG. 1, according to one or more aspects described herein.

FIG. 1 depicts a front view an exemplary container 100. The container 100 may be configured to keep contents cool or warm for an extended period of time. The container 100 may include elements similar to a container described in U.S. Pat. No. 10,143,282, issued on Dec. 4, 2018 and filed 6 Mar. 2017, the entire contents of which are incorporated herein by reference in their entirety for any and all non-limiting purposes. FIG. 2 depicts a back view of the container 100, and FIGS. 3-4 depict side views of the container 100. The container 100 generally includes an outer shell 102 that defines a front portion 130, a back portion 160, a left side portion 180, a right-side portion 190, and a base 104. In one example, the front portion 130, the back portion 160, and the side portions 180, 190 may collectively be referred to as the sidewall of the container 100. The container 100 additionally includes an opening 110 at a top portion of the container and may include a flap portion 140 that extends above the opening from one or both sides of the front portion 130 or back portion 160. Accordingly, the flap portion 140 is configured to extend above a top of the outer shell 102, and the opening 110. The opening 110 is configured to provide a resealable point of entry into a storage compartment 120 of the container 100. The storage compartment is shown in further detail in FIG. 5. In one example, the opening 110 may include a front side 112 coupled to the front portion 130 and a back side 114 coupled to the back portion 160. The opening 110 may be resealably sealed by closure mechanism 200, where the container 100 may have an open configuration that allows access to the storage compartment 120 and a closed configuration that prevents access to the storage compartment 120. The opening 110 may additionally include a pull tab 116, which is configured to be manually gripped to pull the front and back sides 112 and 114 away from one another to unseal the opening 110. In some examples, the container 100 may include two pull tabs 116 such that a pull tab 116 is arranged on each side of the opening 110.

Figure 6A:
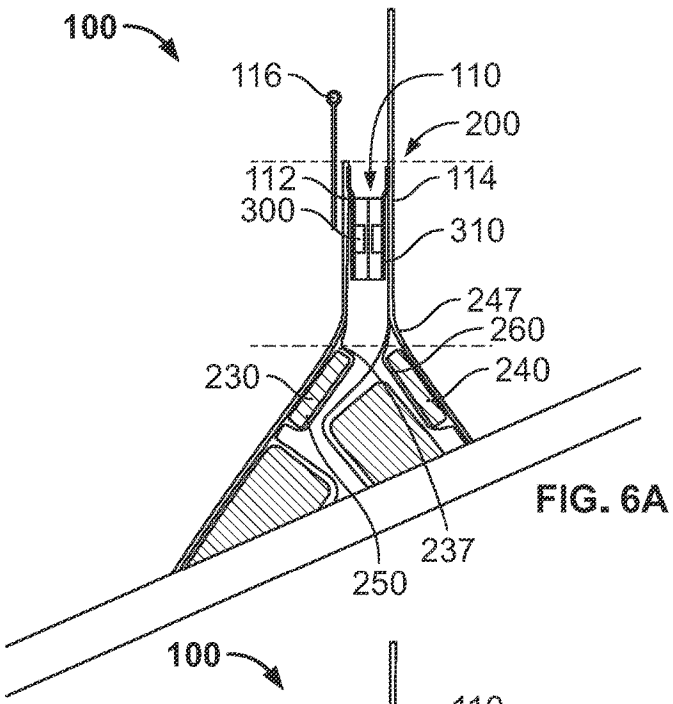
FIGS. 6A-6B schematically depict an enlarged cross-sectional side view of the container of FIG. 5, according to one or more aspects described herein.
Figure 6B:
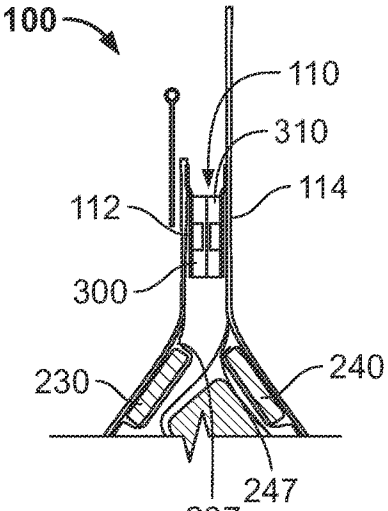
Figure 5:
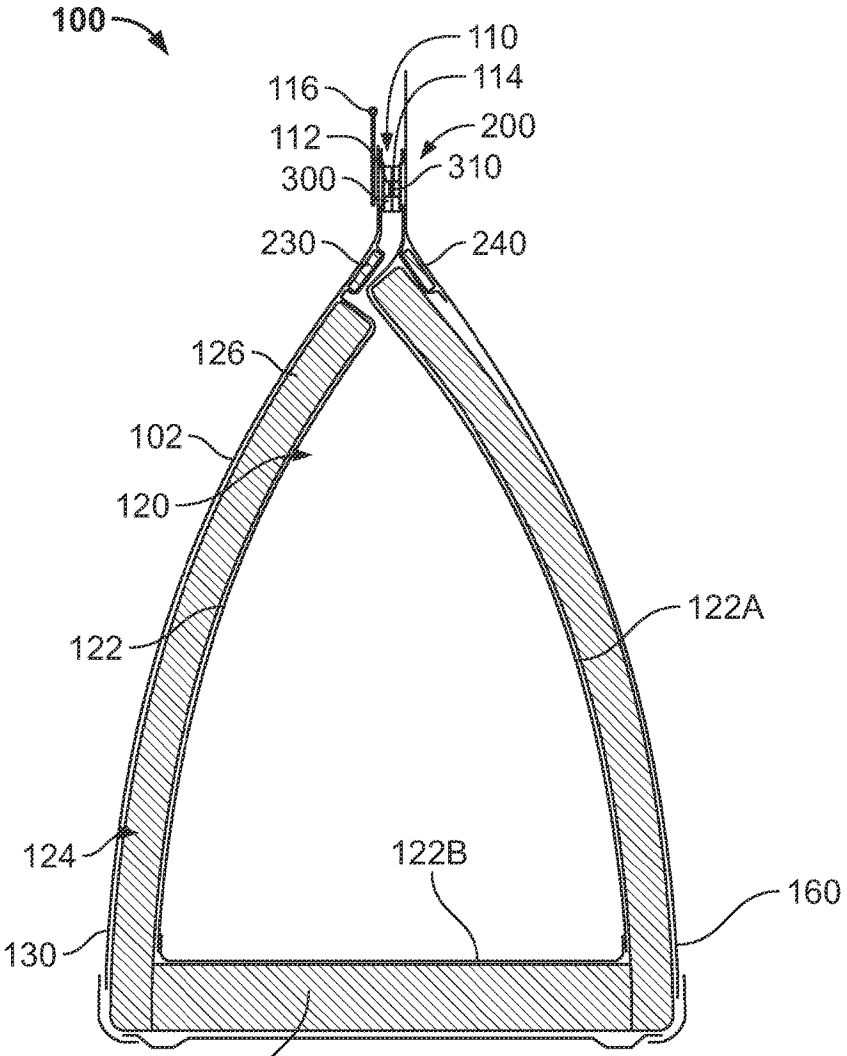
FIG. 5 schematically depicts a cross-sectional side view of the exemplary container of FIG. 1, according to one or more aspects described herein.

As shown in FIGS. 5, 6A, and 6B, the closure mechanism 200 may include a first closure element 300 and a second closure element 310. Optionally, the closure mechanism 200 may also include a first curved member 230, and a second curved member 240. The closure mechanism 200 may form a waterproof and/or airtight seal. The closure elements 300, 310 may be releasable closure elements such as magnetic strips. In some examples, the closure mechanism 200 may include a first magnetic strip 300, a second magnetic strip 310, a first curved member 230, and a second curved member 240. The first magnetic strip 300 may extend along and be coupled to an internal surface of the front portion 130 at a front side 112 of the opening 110, and the second magnetic strip 310 may extend along and be coupled to an internal surface of the back portion 160 at a back side 114 of the opening 110. The first magnetic strip 300 may be magnetically attracted to the second magnetic strip 310 to resealably seal the opening 110 to keep the container 100 in a closed configuration. The first curved member 230 may extend along an internal surface of the front portion 130 and be spaced by a predetermined distance below the first magnetic strip 300. Similarly, the second curved member 240 may extend along an internal surface of the back portion 160 and be spaced a predetermined distance below the second magnetic strip 310. In some examples, the first curved member 230 may be substantially aligned with the upper edge 247 of the second curved member 240. The first curved member 230 may be secured in a front receiver 250 of the front portion 130 of the container 100, and the second curved member 240 may be secured in a back receiver 260 of the back portion 160 of the container 100. When in the closed configuration, the first and second magnetic strips 300, 310 may be substantially aligned with each other, and the first and second curved members 230, 240 may be substantially aligned. Alternatively, the curved members 230, 240 may extend along and be coupled to an exterior surface of the front and back portions 130, 160 respectively. As an example, the receivers 250, 260 may be located along an exterior surface of the outer shell 102. Once a user moves the container 100 to an open configuration by separating the first and second magnetic strips 300, 310, the first and second curved members 230, 240 may act to prevent the container 100 from closing and hold (or maintain) the container 100 in an open configuration. Optionally, the closure mechanism 200 may have only a single curved member 230 or 240 arranged on only one side of the closure (e.g., a single curved member 230 along the front portion 130 of the container 100, or a single curved member 240 along the back portion 160 of the container 100). In some examples, the container 100 may include a secondary closure such as a zipper or other mechanical closure. If a zipper is utilized, the zipper may be a waterproof zipper.

The first and second curved members 230, 240 may exert spring forces in an opposite direction to the magnetic forces that act between the first magnetic strip 300 and the second magnetic strip 310 to prevent the opening 110 of the container 100 from accidentally closing, and these opposing forces may also allow the opening 110 to move from an open configuration to a closed configuration in a controlled manner. The closure mechanism 200 moving from an open configuration to a closed configuration in a slow and controlled manner may prevent any injury to a user from the closure mechanism 200 closing too quickly and provide a safe and effective scaling mechanism.

In particular, the curved members 230, 240 may provide spring forces that act against the magnetic forces of the magnetic strips 300, 310. The curved members 230, 240 may be formed with a curved profile with a concave contour that faces the opening 110 of the container 100. The first curved member 230 may have a first end 232, a second end 234, and a curved member body 236 that extends between the first end 232 and the second end 234. Similarly, the second curved member 240 may have a first end, a second end, and a curved member body that extends between the first end and the second end. In addition, the curved members 230, 240 may be fixedly attached to the front portion 130 and back portion 160 at the curved members 230, 240 respective attachment points 235 that may be located at or near a center of each curved member 230, 240. Each end 232, 234, may be free to move and slide within their respective receivers 250, 260 as the curved members 230, 240 may deform or flex during the opening and closing process. When the opening 110 is in an open configuration, the curved members 230, 240 are in an undeformed state or substantially undeformed state (i.e., the curved members 230, 240 have their original curved profile shape or a first curved configuration). When a user applies a force to move the opening 110 towards a closed configuration, the magnetic forces between the magnetic strips 300, 310 begin pulling the front side 112 toward the back side 114 of the opening 110, while simultaneously, the curved members 230, 240 begin exerting spring forces pulling the front side 112 and the back side 114 away from each other. These opposite forces cause the opening 110 to close in a slow and controlled manner. The curved members 230, 240 may be similar to those described in U.S. patent application Ser. No. 17/673,688 filed on Feb. 16, 2022, which is incorporated herein in its entirety for any and all non-limiting purposes.

FIGS. 5, 6A, and 6B schematically depict a cross-sectional side view of the insulating container 100. As shown in FIGS. 5, 6A, and 6B, the magnetic strips 300, 310 may be located at the opening 110, and the curved members 230, 240 may be spaced below their respective magnetic strips 300, 310. In the illustrated example, an inner liner 122 forms a chamber, receptacle, or storage compartment 120 for receiving and storing contents therein. The insulating container 100 may include an inner liner 122, an insulating layer 124, and an outer shell 102. The insulating layer 124 may be located between the inner liner 122 and the outer shell 102, and may be formed as a foam insulator to assist in maintaining the internal temperature of the storage compartment 120 for storing contents desired to be kept cool or warm. In addition, the first curved member 230 may be positioned between the inner liner 122 and the outer shell 102. As shown in FIGS. 5, 6A, and 6B, the back curved member 240 may be located between the insulating layer 124 and the outer shell 102. In addition, the front receiver 250 and back receiver 260 may be formed to secure the curved members 230, 240 on all sides such that the curved members 230, 240 are sealed within the receivers 250, 260 respectively. The curved members 230, 240 may be slid into their respective receivers 250, 260 before ends of the receivers 250, 260 are sealed. The receivers 250, 260 may be formed from the same material as the inner liner 122 or from a similar material as known to one skilled in the art using a welding, gluing, taping or other process(es) to join the receivers 250, 260 to container 100. As discussed above, a center portion of the curved members 230, 240 may be fixedly attached to the respective front and back portions 130, 160 to allow the ends of each curved member 230, 240 to move freely. Alternatively, or optionally, the curved members 230, 240 may not be fixedly attached at any point or multiple points and be allowed to move or slide freely within their respective receivers 250, 260. For example, the curved members 230, 240 may be partially or fully contained within their respective receivers 250, 260 and may be fixedly attached in some examples at multiple positions, such as near the center and near each end.

The insulating layer 124 may be located in between the inner liner 122 and the outer shell 102, and may be unattached to either the inner liner 122 or the outer shell 102 such that it floats between the inner liner 122 and the outer shell 102. In one example, the inner liner 122 and the outer shell 102 may be connected at a top portion 108 of the insulating container 100 such that the insulating layer 124 may float freely within a pocket formed by the inner liner 122 and the outer shell 102. The inner layer or inner liner 122 can be formed of a first inner liner sidewall portion 122A and a bottom inner liner portion 122B. The first inner liner sidewall portion 122A and the bottom inner liner portion 122B can be secured together by, for example, welding or other means, to form the storage compartment 120. In some examples, the storage compartment 120 may be a "dry bag," or vessel for storing contents. In one example, a tape, such as a TPU tape, can be placed over the seams to help join and seal the sections of the storage compartment 120 after the sections of the storage compartment 120, after the first inner liner sidewall portion 122A and the bottom inner liner portion 122B are secured or joined together. The tape may also be used to seal the seams formed between the first inner liner sidewall portion 122A and the bottom inner liner portion 122B to provide an additional barrier to liquid to prevent liquid from either entering or exiting the storage compartment 120. The inner liner 122 can, thus, either maintain liquid in the storage compartment 120 of the insulating container 100 or prevent liquid contents from entering into the storage compartment 120 of the insulating container 100. It is also contemplated, however, that the inner liner 122 may be formed as an integral one-piece structure that may be secured within the outer shell 102. The liner material may comprise a thermoplastic polyurethane (TPU), thermoplastic elastomer (TPE), thermoplastic copolyester elastomers (TPC), or other materials known to one skilled in the art. Optionally, the inner liner may be treated with or constructed from materials that have antimicrobial properties or other performance additives.

Figure 7A:
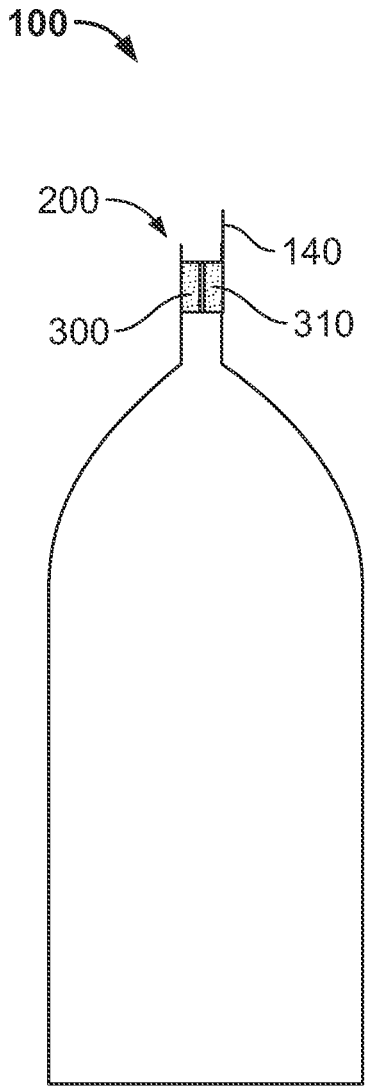
FIGS. 7A-7B schematically depict cross-sectional views of a container in respective unfolded and folded configurations, according to one or more aspects described herein.
Figure 7B:
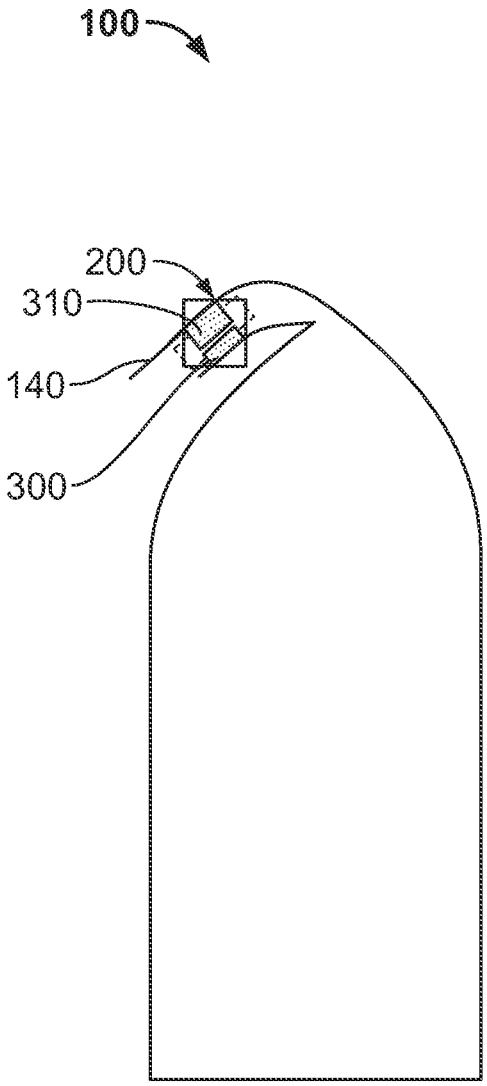

In one example, the closure mechanism 200 used to seal the opening 110 may be substantially waterproof or water resistant and prevent or reduce liquid ingress into and/or egress from the insulating container 100. Further, the flap portion 140 may be folded to further seal the opening 110 as shown in FIGS. 7A-7B. The flap portion 140 may fold between the magnetic strips 300, 310 and the curved members 230, 240. The flap portion 140 may be further secured in the folded position by the use of magnets, buckles, straps, hook and loop fasteners, zippers, and/or other known securing means.

Referring back to FIGS. 1 and 2, various handles, straps or loops, and webs (e.g., 132, 134, 136) may also be included on the insulating container 100 for carrying, holding, or securing the insulating container 100. In this regard, the outer shell 102 can also include multiple reinforcement areas or patches, e.g., 107A-107C that are configured to assist in structurally supporting the optional handles or straps (e.g., 132, 134, 136, 162). These reinforcement areas or patches may be located on an inner or outer surface of the outer shell 102. The handles or straps (e.g., 132, 134, 136, 162) and other attachments may be stitched, glued, welded, or riveted, or attached using any other attachment methodology, or combination of methodologies, to the main structure of the insulating container 100.

The insulating the container 100 may include a plurality of carry handles 136 that are connected to the front portion 130 of the insulating container 100 and the back portion 160 of the insulating container 100. In one example, a shoulder strap can be attached to attachment rings 138A, 138B. The insulating container 100 may additionally include side handles 132 to facilitate carrying of the insulating container 100. Additionally, webbing formed as loops 134 may be sewn onto or otherwise attached to the straps of the handles 136. The loops 134 can be used to attach items (e.g., carabineers, dry bags) to the insulating container 100. In one example, the carry handles 136, side handles 132, and loops 134 may be constructed of nylon webbing. Other materials may include, among others, polypropylene, neoprene, polyester, TPU, TPC, TPE, Dyneema, Kevlar, cotton fabric, leather, plastics, rubber, or rope.

In one example, the rings 138A-138D may be Acetal (POM) D-rings. The attachment rings 138A-138D may be constructed from one or more polymers, metals, ceramics, glasses, alloys, or combinations thereof. In certain specific examples, the attachment rings 138A-138D may be constructed from nylon, polypropylene, neoprene, polyester, Dyneema, and Kevlar, cotton fabric, leather, plastics, rubber, or rope or a mixture thereof. In some examples, the attachment rings 138A-138D may include some amount of recycled material. The attachment rings 138A-138D may include other shapes, sizes, and configurations other than the depicted "D" shape. Examples include round, square, rectangular, triangular, or rings with multiple attachment points.

FIG. 1 further depicts a base 104 and a base support ridge 106. The base support ridge 106 may provide structural integrity and support to the insulating container 100 (also referred to as an insulating device 100) when the insulating container 100 is placed onto a surface.

The flap portion 140 may have a front side 142 and a back side 144. Further, in one implementation, the flap portion 140 may be configured to fold such that a top flap portion 146 folds over onto a bottom flap portion 148. When folded, the top flap portion 146 may be removably coupled to the bottom flap portion 148 by a secondary closure mechanism. In one example, both of the top flap portion 146 and the bottom flap portion 148 may include magnetic elements (e.g., permanent magnets and magnetic materials) that are embedded within the container 100 along the length, L, of the opening 110. In one example, a single magnetic strip may be embedded in one or more of the top flap portion 146 and the bottom flap portion 148 and extend along at least a portion of the length of 106. In some examples, a top flap portion 146 may be taller than the bottom flap portion 148, or in some examples, the top flap portion 146 may have the same height as the bottom flap portion 148. Additionally, or alternatively, a series of one or more discrete magnetic elements may be embedded in one or more of the top flap portion 146 and the bottom flap portion 148 and extend along at least a portion of the length, L. In other implementations, hook and loop fasteners, or other fastener types, may be used in combination with or as an alternative to magnetic fasteners to removably couple the top flap portion 146 and the bottom flap portion 148 to one another.

In the illustrated example, the flap portion 140 may be folded where the top flap portion 146 may be held in a folded configuration by buckles and straps that extend over the top of the container 100 between the back portion 160 and the front portion 130. Strap 164 and fastener element or buckle 166A, which may be coupled to the carry handle 136 on the front portion 130, may be utilized to hold the top flap portion 146 in a folded configuration when removably coupled to a corresponding fastener element or buckle 166B coupled to the carry handle 136 of the back portion 160 of the container 100.

Figure 8B:
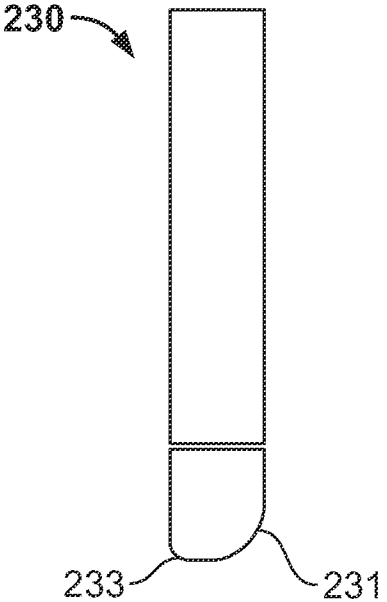
FIG. 8B illustrates a side view of the exemplary curved member of FIG. 8, according to one or more aspects described herein.
Figure 8A:
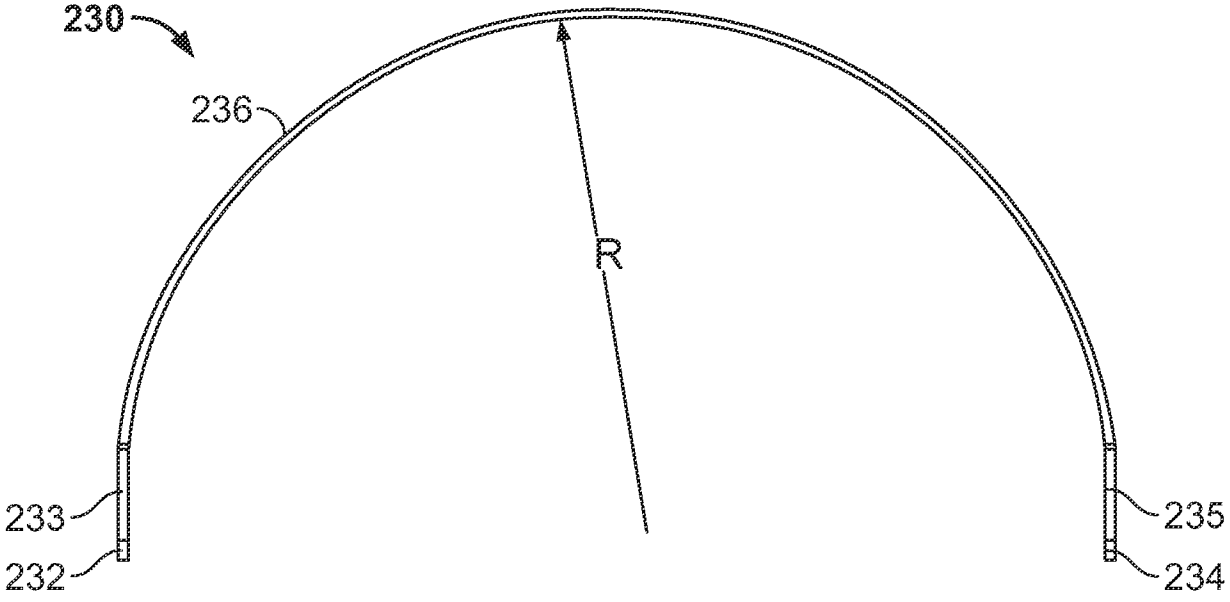
FIG. 8A illustrates a top view of an exemplary curved member of a closure mechanism of the container of FIG. 1, according to one or more aspects described herein.

FIGS. 8A-8B depict an exemplary curved member 230, which may also represent curved member 240 as the two curved members may be identical in shape and size. FIG. 8A illustrates a top view of curved member 230 where the curved members 230, 240 have curves that move away from each other, such that the curved members 230, 240 may have a convex outward facing surface. Alternatively, or optionally, the curved members 230, 240 may both curve toward each other such that the curved members have the concave side facing outward. As another option, the curved members 230, 240 may have both have curvature that is arranged in the same direction (e.g., the concave sides of both curved members 230, 240 face toward the front of the container 100 or the concave sides of both curved members 230, 240 face toward the rear of the container 100. The curved member 230 may have a curvature defined by an interior radius, R. The curvature may be described as a function of the length, L, of the opening 110, the strength of the magnets (i.e., the strength of magnet strips 300, 310), the horizontal distance between ends 232, 234, and the desired stiffness of the curved members 230, 240. As shown in FIG. 8A, portions of the curved members 230, 240 may have straight sections 233, 235. In some examples, the curvature of the curved members 230, 240 may be expressed as a percentage of a length, L, of the opening 110 when length, L, is measured when the opening 110 is in the closed configuration. For example, the curvature of the curved member 230 may be approximately 30 percent of the length, L, or approximately 38 percent of the length, L, or within a range of 25 percent and 45 percent of the length, L, of the opening 110, or within a range of 15 percent of the length, L, and 60 percent of the length, L.

Figure 12:
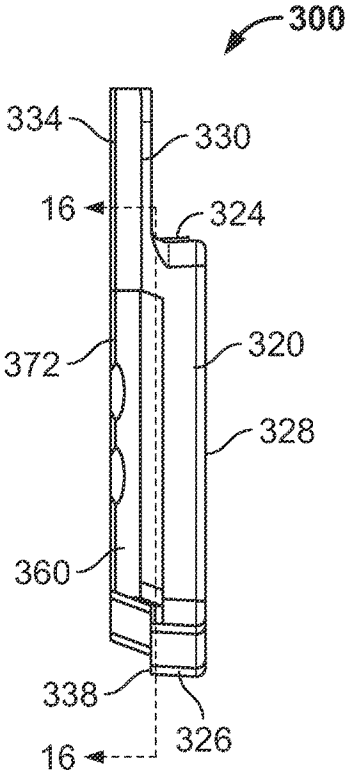
FIG. 12 illustrates a side view of the magnetic strip of the closure mechanism of FIG. 9A, according to one or more aspects described herein.
Figure 16:
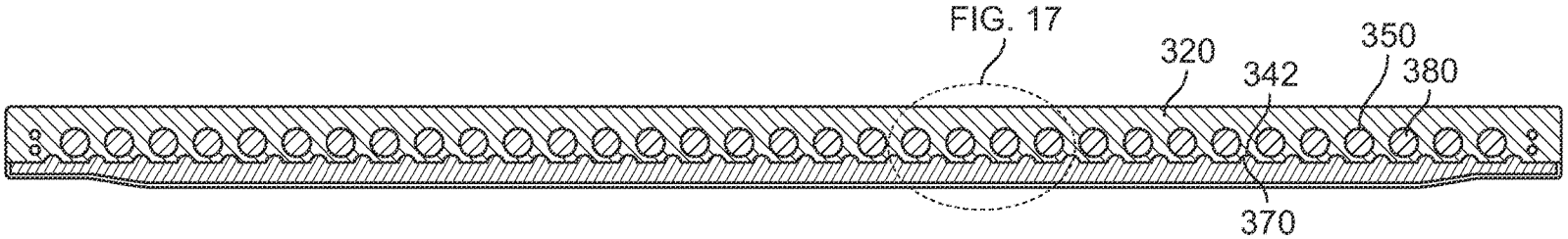
FIG. 16 illustrates a cross-sectional view of the magnetic strip of the closure mechanism of FIG. 12 along line 16-16, according to one or more aspects described herein.

As described above, the first curved member 230 may have a first end 232, a second end 234, and a curved member body 236 that extends between the first end 232 and the second end 234. Similarly, the second curved member 240 may have a first end, a second end, and a curved member body that extends between the first end and the second end. Each end 232, 234, of the curved members 230, 240 may have a curved profile as shown in FIG. 12. As shown, each end 232, 234, may have a lower portion 231 with a larger radius than an upper portion 233. In some examples, the radius for the lower portion 231 may be up to three times larger than the radius of the upper portion 233. Alternatively, each end 232, 234, may have a lower portion with a radius that is equal with the upper portion. By having a rounded profile on each end 232, 234, the curved members 230, 240 may avoid damaging any of the portions of the container 100 as the ends 232, 234, move during the opening and closing process (i.e., the outer shell 102, the inner liner 122, the insulating layer 124, or the receivers 250, 260).

The curved members 230, 240 may be formed of various materials and dimensions to create the desired spring forces for the closure mechanism 200. For instance, in one example, the curved members 230, 240 may include a core portion formed from a steel alloy. In other examples, the curved members 230, 240 may be formed from other metallic materials, such as aluminum based alloys, titanium alloys, or other metallic materials. The curved members 230, 240 may be formed using an extrusion process and may have a substantially constant cross-sectional shape. The curved member 230, 240 may have a substantially rectangular cross-sectional shape although alternate cross-sectional shapes are contemplated such as square, oval, round, elliptical, triangular, or other geometric shapes. In some examples, the curved members 230, 240 may have a concave or convex shaped cross-sectional shape.

When using a metallic material for the core portion, the curved members 230, 240 may include a non-metallic outer layer. The non-metallic outer layer may be an elastomeric or polymeric material, a polyethylene-based material, or a polyvinyl chloride-based material. This encapsulation helps to protect the core portion from corrosion and also helps to protect the container components from any damage caused by the movement of the curved members 230, 240. The non-metallic outer layer may also help to reduce friction of the curved members 230, 240 to allow free movement of the ends 232, 234. The metallic core portion may have a constant or variable thickness. The encapsulation may be applied as a heat shrink tube onto the metallic core portion, may be injection molded, overmolded, dipped, or powder coated onto the core portion, or may be encapsulated by other means known to one skilled in the art.

In alternate examples, the curved members 230, 240 may be formed from a non-metallic material such as a high strength polymer, such as polycarbonate, a fiber filled glass material (such as carbon or polymer), or a composite material. A non-metallic curved member may have similar end geometry as described above and may or may not be encapsulated in an elastomeric material. As another option, the thickness may be variable as to adjust the stiffness and durability of the curved member.

FIGS. 9A-19 illustrate exemplary magnetic strip 300, 310 of the closure mechanism 200. The two magnetic strips 300 and 310 may be used to form the closure mechanism 200 of the opening 110. As previously described, the closure mechanism 200 may be used to resealably seal the opening 110. When the closure mechanism is in a closed configuration, the magnetic strips 300, 310 contact each other. The magnetic strips 300, 310 may have a magnetic strength sufficient to create a seal that is partially or fully watertight and/or airtight. By way of example, such a magnetic strength can be achieved of approximately 4500 Gauss, or within a range of 3500 Gauss and 5500 Gauss, where the magnetic strength is checked with the opening 110 in a closed configuration using a magnetic tester placed directly between the two magnetic strips 300, 310. Alternatively, the magnetic strength may be tested using other means known one skilled in the art.

The magnetic strips 300, 310 illustrated in FIGS. 9A-19 may have the similar or the same construction described. While FIGS. 9A-19 illustrate the construction of magnetic strip 300, magnetic strip 310 may have the same or similar construction as described with respect to magnetic strip 300. As shown in the illustrated example of FIG. 9A, magnetic strip 300 may include a tapered region 317 at either or both ends. This tapered region 317 may assist in the proper fit and/or attachment of the magnetic strips 300, 310 and to ensure a proper seal of the closure mechanism 200. The tapered region 317 may be formed on both of the magnetic strips 300, 310 or may only be on one of the magnetic strips. As shown in FIG. 9B, magnetic strip 310 may have a constant thickness and not have the tapered region on the ends. Optionally, both magnetic strips 300, 310 may not have a tapered region and have a constant thickness. In addition, it is contemplated that each magnetic strip 300, 310 may comprise a third or fourth polymeric member.

Figure 19:
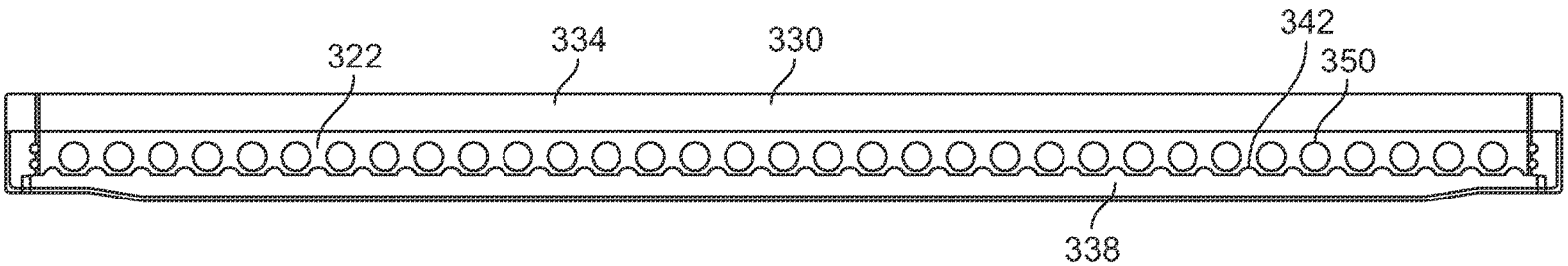
FIG. 19 illustrates a front view of a portion of the magnetic strip of the closure mechanism of FIG. 9A, according to one or more aspects described herein.

Each magnetic strip 300, 310 may comprise a first member 320, a second member 360 and a plurality of magnetic elements 380. The first member 320 may include a plurality of receivers 350 in a front surface 322, where the plurality of receivers 350 may be aligned in a linear orientation as shown in FIG. 19. Optionally, the receivers 350 may be arranged in an array with multiple rows and columns. The spacing between receivers 350 may be minimal or even contact each other where a first receiver may intersect with a second receiver. The first member 320 may also include a top surface 324, a bottom surface 326 opposite the top surface 324, and a rear surface 328 opposite the front surface 322, and an upper shelf member 330 that extends beyond the top surface 324. The upper shelf member 330 connects to the front surface 322 forming an upper shelf surface 332 extending between the front surface 322 and a connection surface 334 of the upper shelf member 330. The upper shelf member 330 may be used as a means of attaching or coupling the magnetic strip 300 to the container 100 using methods known in the art. The connection surface 334 may be spaced apart a predetermined distance from the front surface 322. The first member 320 may further include a lower shelf member 336. The lower shelf member 336 may include an engaging surface 338 that is spaced a predetermined distance away from and below the front surface 322. The engaging surface 338 may be spaced below the front surface 322 and also below the connection surface 334 as shown in FIG. 12. A lower shelf surface 340 may be formed between the front surface 322 and the engaging surface 338. The lower shelf surface 340 may include includes a plurality of recesses 342 that extend toward the upper shelf surface 332 (i.e. toward the top surface 324), where a peak of each recess 342 may be located in between two receivers 350.

Figure 17:
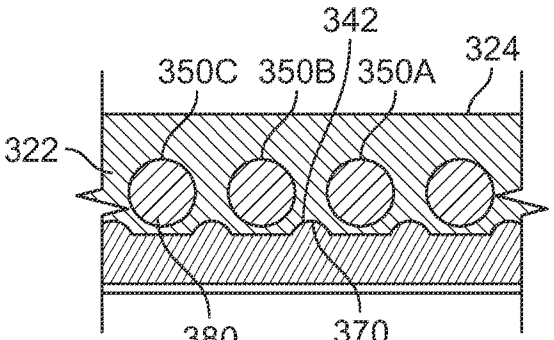
FIG. 17 illustrates an enlarged view of a portion of the magnetic strip of FIG. 16, according to one or more aspects described herein.
Figure 18:
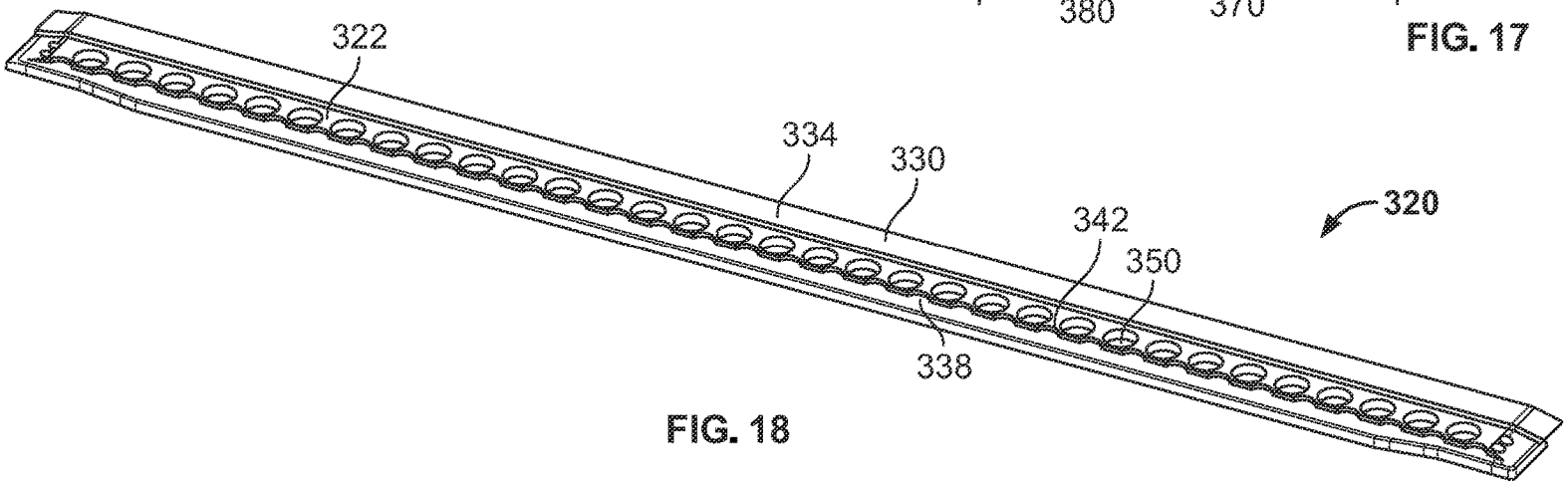
FIG. 18 illustrates a perspective view of a portion of the magnetic strip of the closure mechanism of FIG. 9A, according to one or more aspects described herein.

Each receiver 350 may include a sidewall surface 352 and a bottom surface 354. In some examples, each receiver 350 may include a slot 356 along the sidewall surface 352, where the slot 356 extends from the bottom surface 354 to the front surface 322. A plurality of magnetic elements 380 may be received in the plurality of receivers 350. For examples, each magnetic element 380 may be individually received in a corresponding receiver 350. In some examples, an upper surface 382 of each magnetic element may be spaced below the front surface 322 of the first member 320 a predetermined distance, such as within a range of 0.05 mm and 0.40 mm, or within a range of 0.025 mm and 0.060 mm. While the magnetic elements 380 are depicted as circular magnetic elements, it is contemplated that the magnetic elements may be of any shape, such as rectangular, square, triangular, oval, or other geometric shape as known to one skilled in the art. The magnetic elements 380 may be oriented such that adjacent magnetic elements 380 have opposite polarity. For example, as shown in FIG. 17, the magnetic element 380 within receiver 350A may face its north pole toward the front surface 322, the magnetic element 380 within receiver 350B may face its south pole toward the front surface 322, and the magnetic element 380 within receiver 350C may face its north pole toward the front surface 322. Alternatively, the magnetic elements 380 may have an alternating or repeating polarity. For example, there may be two or more magnetic elements 380 with the same polarity followed by two or more magnetic elements 380 with opposite polarity. The magnetic elements 380 may be charged before or after they are installed in their receivers 350.

A second member 360 may be joined or connected to the first member 320 to cover the plurality of magnetic elements 380 that are within the plurality of receivers 350 of the first member 320. The second member 360 may help secure the magnetic elements 380 to the magnetic strip 300. The slots 356 may prevent air bubbles from forming over the magnetic elements 380 when the second member 360 is joined to the first member 320 if the second member 360 is joined to the first member 320 using a molding process (e.g. a second shot injection molding process). The slots 356 provide a small volume where the air can be pushed while having a small volume to prevent the slot 356 from being filled with molten polymeric material during a molding process. The second member 360 may comprise an upper surface 362 that contacts the upper shelf surface 332 of the first member 320, a front surface 364 that contacts the front surface 322 of the first members 320, and a plurality of protrusions 366 that extend from the front surface 364 of the second member 360. Each protrusion 366 may extend into a corresponding receiver 350 of the first member 320. The protrusions 366 may help secure the magnetic elements 380 in the receivers 350. In some examples, a portion of each protrusion (or at least one protrusion) 366 may contact a top surface 382 of a corresponding magnetic element 380 located in the corresponding receiver 350. The second member 360 may further comprise an engaging surface 368 that contacts the lower shelf surface 340 of the first member 320. The engaging surface 368 may include a plurality of projections 370 that extend into the plurality of recesses 342. Each projection 370 is received in and contacts a corresponding recess 342 of the first member 320. In addition, each projection 370 may fit into each corresponding recess 342 such that the engaging surface 368 of each projection 370 has the same geometry as each recess 342 of the lower shelf surface 340 such that the corresponding surfaces that fit together free of any gaps or with a minimal gap between them. Additionally, the second member 360 may comprise a rear surface 372 opposite the front surface 364, where the rear surface 372 may be substantially coplanar with the connection surface 334 of the upper shelf member 330.

In some examples, the magnetic strips 300, 310 may be formed using an injection molding process with the magnetic elements 380 installed in a step after molding the first member 320 and before molding the second member 360. For example, the first member 320 may be molded and then each of the magnetic elements 380 may be installed into each corresponding receiver 350. The magnetic elements 380 may be installed into the receivers 350 and leave a small gap between a top surface 382 of each magnetic element and the front surface 322. Once the magnetic elements 380 are positioned in their corresponding receivers 350, the second member 360 may be molded onto the first member 320 to cover and secure the magnetic elements 380 to the magnetic strip. In one example, the magnetic strips 300 and 310 may be constructed from a thermoplastic polyurethane (TPU). Each member 320, 360 may have a thickness great enough to secure the magnetic elements 380 while not significantly degrading the strength of the magnetic elements 380. However, it is contemplated that combination of polymers, metals, or alloys, fabrics, or carrier scrims among others, may be used to construct the magnetic strips 300 and 310. The first member 320 and second member 360 may be made of the same material or different material. The materials may have hydrophobic properties and be easily cleaned. However, it is contemplated that combination of polymers, metals, or alloys, among others, may be used to construct the magnetic strips 300, 310.

Figure 9A:
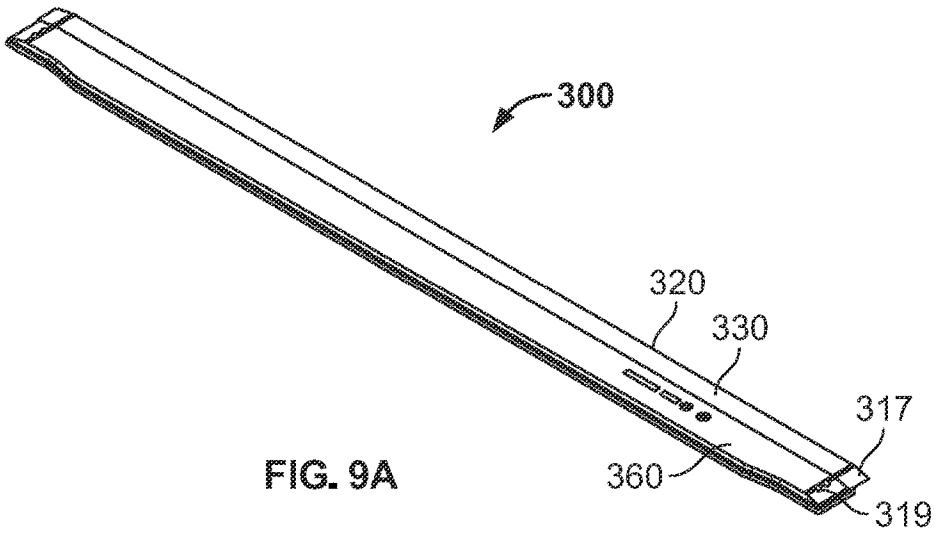
FIG. 9A illustrates a perspective view of a magnetic strip of a closure mechanism of the container of FIG. 1, according to one or more aspects described herein.
Figure 9B:
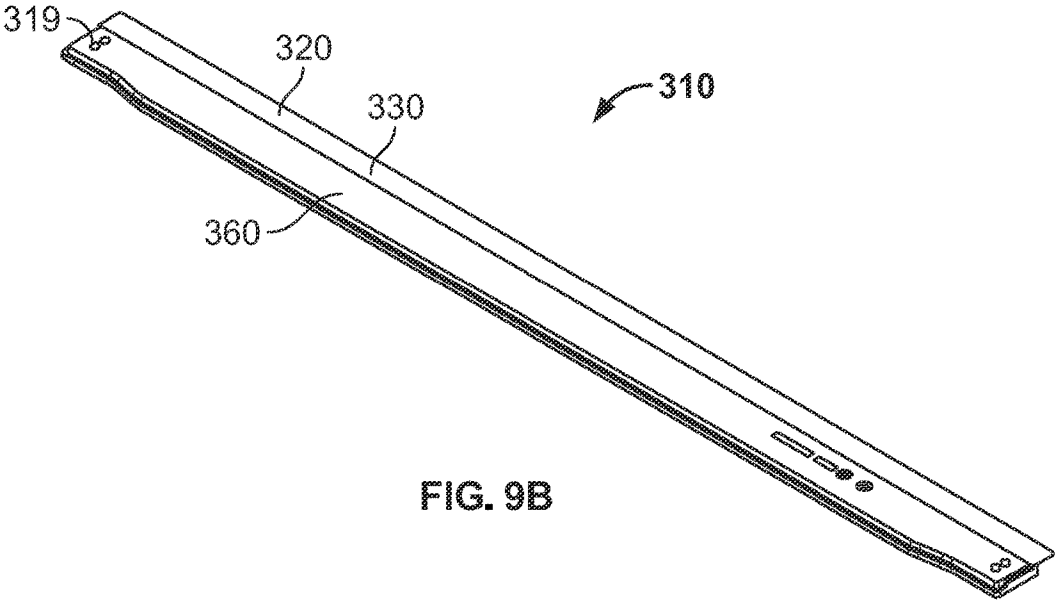
FIG. 9B illustrates a perspective view of a magnetic strip of a closure mechanism of the container of FIG. 1, according to one or more aspects described herein.
Figure 10:
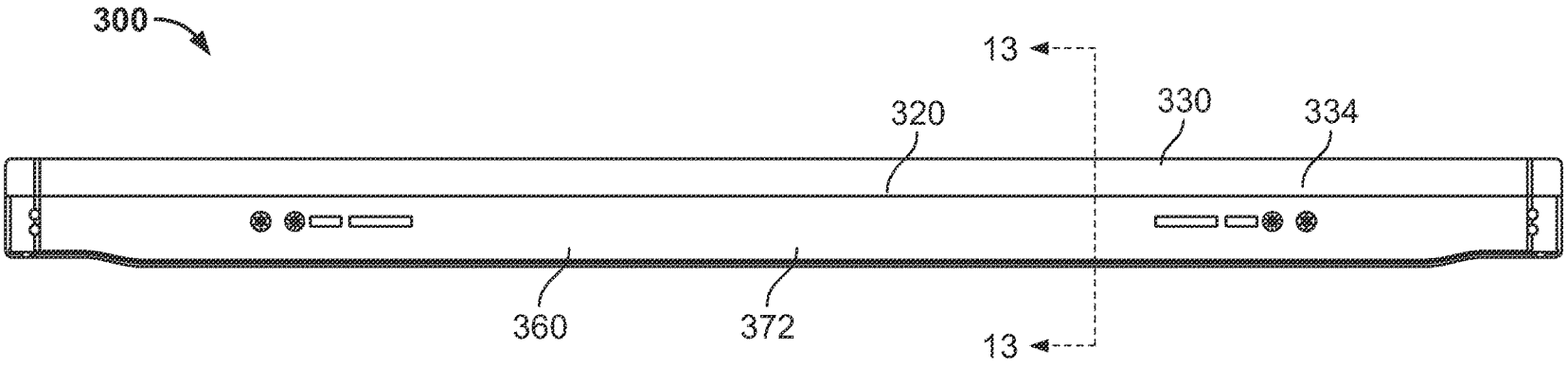
FIG. 10 illustrates a front view of the magnetic strip of the closure mechanism of FIG. 9A, according to one or more aspects described herein.
Figure 11:
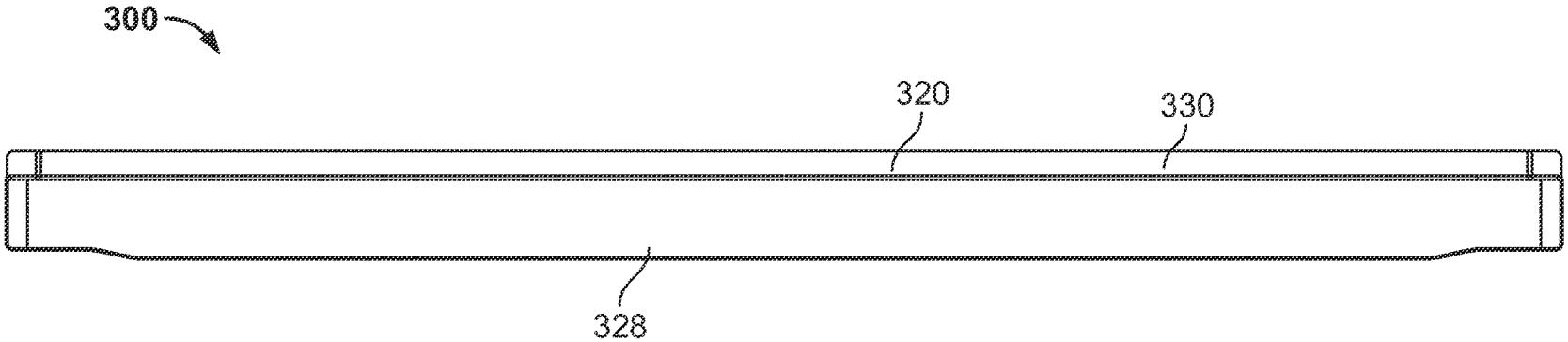
FIG. 11 illustrates a rear view of the magnetic strip of the closure mechanism of FIG. 9A, according to one or more aspects described herein.
Figure 15:
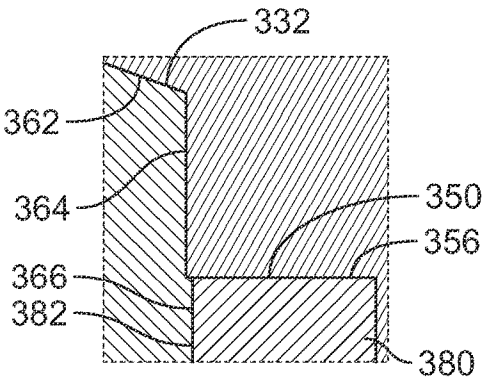
FIG. 15 illustrates an enlarged view of a portion of the magnetic strip of FIG. 13, according to one or more aspects described herein.
Figure 14:
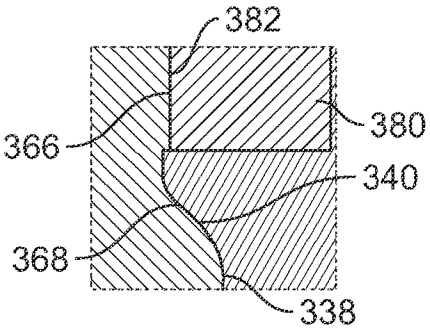
FIG. 14 illustrates an enlarged view of a portion of the magnetic strip of FIG. 13, according to one or more aspects described herein.
Figure 13:
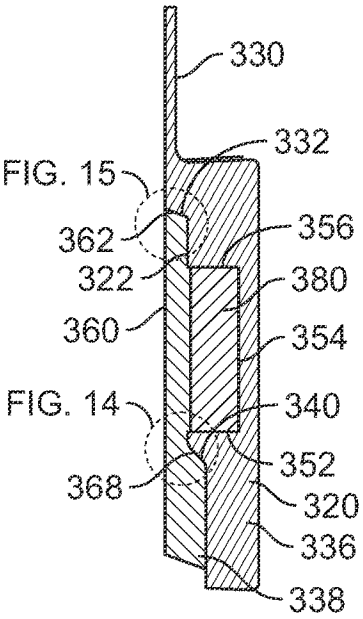
FIG. 13 illustrates a cross-sectional view of the magnetic strip of the closure mechanism of FIG. 10 along line 13-13, according to one or more aspects described herein.

The magnetic strips 300 and 310 may be coupled to the front portion 130 and back portion 160 using any fixation methodology, technique and/or technology. The connection surface 334 and the rear surface 372 may be bonded or joined to the front portion 130 of the outer shell 102. In some examples, the ends of each magnetic strip 300, 310 may be welded to the container 100. To prevent distortion of the magnetic strips 300, 310 during the joining process, each magnetic strip 300, 310 may include one or more relief holes or openings 319 near the end of each magnetic strip 300, 310 as shown in FIGS. 9A-9B. The relief holes 319 may be outboard of the receivers 350 and may help to prevent any distortion of the magnetic strips 300, 310 during the joining process by providing a location to receive any flowable material generated by the joining process. The relief holes 319 may be blind holes with a predetermined depth, or alternatively, may also extend through the magnetic strip 300, 310. The relief holes 319 may also be located on the tapered region 317 of one of the magnetic strips 300, 310 and have a diameter that is smaller than the diameter of the receivers 350. While the illustrated examples show two relief holes 319 near each end of the magnetic strips 300, 310, the number of relief holes 319 may be a single hole, 3 holes, or more than 3 holes near each end. In addition, the relief holes 319 may have any geometric shape. It is further contemplated that the magnetic elements 380 secured within the receivers 350 may be constructed from any material, without departing from the scope of this disclosure.

The primary seal of the insulating container 100 is created by the closure mechanism 200 of the opening 110. In particular, when the closure mechanism 200 is brought into a closed configuration, the rear surface 328 of the first member 320 of magnetic strip 300 may contact the rear surface 328 of the first member 320 of magnetic strip 310, which creates a seal due to the magnetic attraction of the magnetic strips 300, 310. Alternatively, a seal can be created by contacting the rear surface 372 of the second member 360 of magnetic strip 300 with the rear surface 372 of the second member 360 of magnetic strip 310, which creates a seal due to the magnetic attraction of the magnetic strips 300, 310. In addition, a secondary seal may be created by the folding of the flap portion 140. The primary and secondary seals may combine to make the insulating container 100 substantially water and/or airtight. In certain specific examples, the insulating container 100 may be configured to retain water (e.g., melted ice) without leakage or with reduced leakage of water from the storage compartment 120 through the opening 110 and out to the external environment. In certain specific examples, the insulating container 100 may be configured to be positioned on its side (e.g., front portion 130 or back portion 160) and/or positioned in a downward facing orientation (with opening 110 facing downward) and the container 100 may be configured to prevent or substantially reduce the egress of water held within the storage compartment 120 when held in one of these positions for prolonged periods of time. In certain specific examples, the insulating container 100 may be configured to allow less than 5%, 2%, 1%, 0.5%, 0.1%, 0.05%, or 0.01% of the water (or water and ice combination) held within the storage compartment 120 to leak out though the opening 110 when the insulating container 100 is held for at least 1 minute, 2 minutes, 5, minutes, 10 minutes, 15 minutes, 20 minutes, 25 minutes, 30 minutes, 35 minutes, 45 minutes, or 1 hour with the opening 110 facing downward at an incline of: 90 degrees (i.e., upside down), 60 degrees, 45 degrees, 30 degrees, or 0 degrees (i.e., the container held on front portion 130 or back portion 160).

Figure 21:
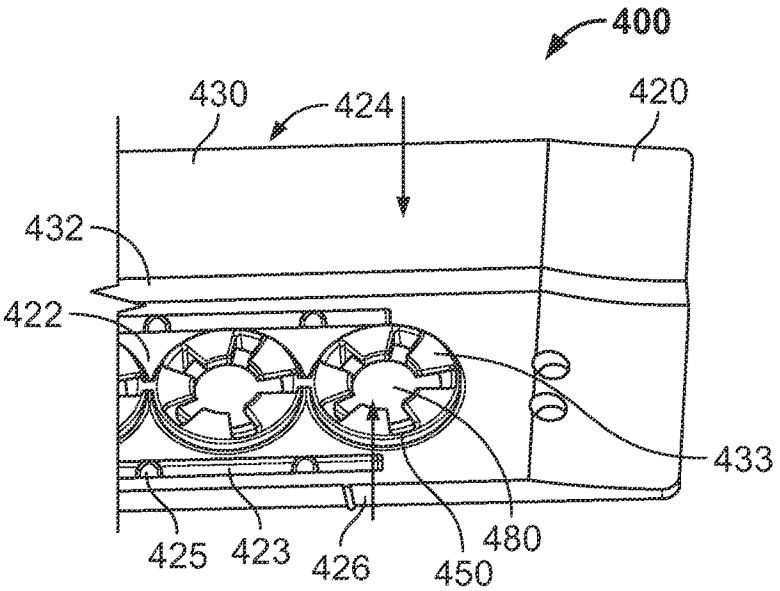
FIG. 21 illustrates a portion of the alternate magnetic strip of FIG. 20 with a portion removed for clarity, according to one or more aspects described herein.
Figure 20:
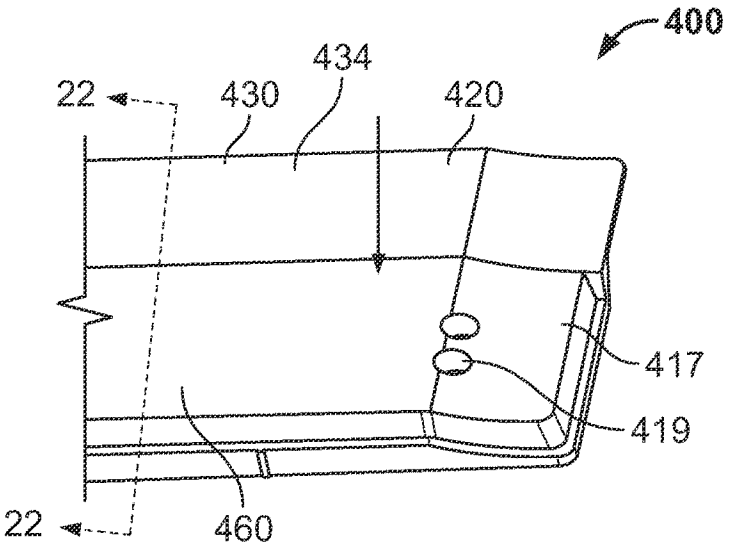
FIG. 20 illustrates a portion of an alternate magnetic strip for a closure mechanism of the container of FIG. 1, according to one or more aspects described herein.
Figure 22:
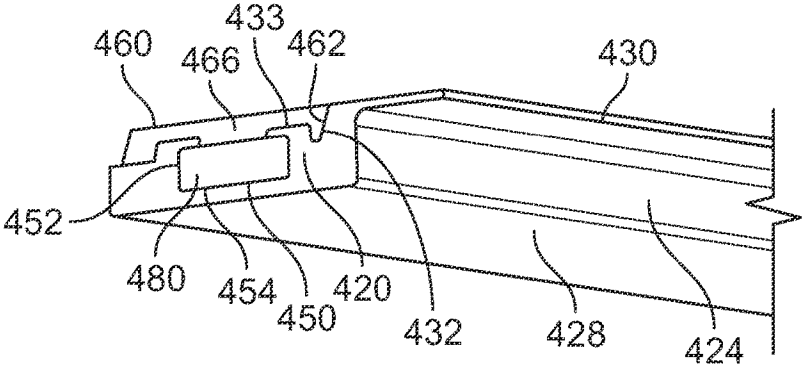
FIG. 22, illustrates a perspective cross-sectional view of the alternate magnetic strip of FIG. 20 along line 22-22, according to one or more aspects described herein.
Figure 24:
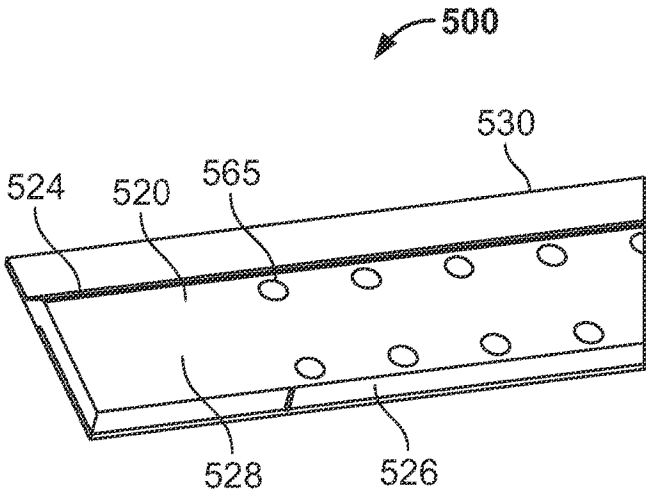
FIG. 24 illustrates a rear perspective view of a portion of the alternate magnetic strip of FIG. 23, according to one or more aspects described herein.

FIGS. 20-22 depict an alternative magnetic strip 400 that may be configured to replace magnetic strips 300 and/or 310 for closure mechanism 200 for an exemplary container 100. The magnetic strip 400 may be formed from a first member 420, a second member 460, along with a plurality of magnetic elements 480. As shown in FIG. 20, magnetic strip 400 may include a tapered region 417 at either or both ends. This tapered region 417 may assist in the proper fit and/or attachment of the magnetic strips 400 and to ensure a proper seal of the closure mechanism 200. The tapered region 417 may be formed on both of the magnetic strips 400 or may only be on one of the magnetic strips. In some examples, magnetic strip 400 may not include a tapered region 417.

The first member 420 may include a plurality of receivers 450 that are formed with a plurality of retention members 433 that partially cover each magnetic element 480. The first member 420 may include a front surface 422, a top surface 424, a bottom surface 426 opposite the top surface 424, and a rear surface 428 opposite the front surface 422, and an upper shelf member 430 that extends beyond the top surface 424. The upper shelf member 430 connects to the front surface 422 forming an upper shelf surface 432 extending between the front surface 422 and a connection surface 434 of the upper shelf member 430. The plurality of receivers 450 and their corresponding magnetic elements 480 may be aligned in a linear orientation. Optionally, the receivers 450 and magnetic elements 480 may be arranged in an array with multiple rows and columns. The connection surface 434 may be spaced apart a first predetermined distance from the front surface 422.

The first member 420 may further include a channel 423 recessed within the front surface 422. In some examples, the channel 423 may include an aperture or plurality of apertures 425. These apertures 425 may be blind holes or through holes. As explained below, these channels 423 and apertures 425 may assist in securing the second member 460 to the first member 420.

Each receiver 450 may include a sidewall surface 452, a bottom surface 454, and a plurality of retention members 433. The retention members 433 of each receiver 450 may contact a top surface of each corresponding magnetic element 480 to secure the magnetic element 480 to the first member 420. Each retention member 433 may extend outward from the front surface 422 and then extend inward toward a center of each receiver 450. Each retention member 433 may extend partially across the top surface of each magnetic element as shown in FIG. 21. The retention members 433 may be generally triangular in shape, or may be other geometric shapes. In the illustrated example of FIG. 21, each receiver 450 may include five retention members 433 that are each spaced out along a perimeter of the sidewall surface 452 and arranged as a set of retention members. However, the number of retention members may be more than or less than five.

Each magnetic element 480 may be individually received in a corresponding receiver 450. The properties of the magnetic elements 480 with respect to shape and size may be the same as magnetic elements 380 discussed above. In addition, the polarity of the plurality of magnetic elements 480 may be similar to the polarity of the plurality of magnetic elements 380 discussed above.

A second member 460 may be joined or connected to the first member 420 to cover the plurality of magnetic elements 480 that are within the plurality of receivers 450 of the first member 420. The second member 460 may help to secure the magnetic elements 480 to the magnetic strip 400. The second member 460 may comprise an upper surface 462 that contacts the upper shelf surface 432 of the first member 420 and a front surface that contacts the front surface 422. In addition, the second member 460 may comprise a plurality of protrusions 466, where each protrusion 466 is arranged to contact a magnetic element 480 and where each protrusion 466 has a shape that is complementary to each set of retention members 433 of each receiver 450. Each protrusion 466 may extend into a central region of a corresponding receiver 450 between the retention members 433. Additionally, the second member 460 may include a projection or projections (not shown) that extend into the channels 423 of the first member 420. Each projection may include an extension that further extends into the aperture 425. The projections and the protrusions 466 help to form interlocking geometry to further secure the second member 460 to the first member 420.

In some examples, the magnetic strips 400 may be formed using an injection molding process with the magnetic elements 480 installed in the tooling and the first member 420 is molded around the plurality of magnetic elements 480 such that the magnetic elements 480 are secured to the first member 420 when the first member 420 is formed. The magnetic elements 480 may be secured within the tooling using claws or tabs that connect to the circumference of the magnetic elements 480 so the first member 420 and the corresponding retention members 433 are formed with the first member 420. The claws or tabs are then removed, which leaves the magnetic element 480 secured within the receivers 450 of the first member 420. The retention members 433 are formed where the claws or tabs were not located around the magnetic element 480. Each retention member 433 may be formed as part of the first member 420 such that the retention members 433 and the first member 420 are formed as a single unitary member. Next, the second member 460 may be molded onto the first member 420 to further cover and secure the magnetic elements 480 to the magnetic strip 400. The first and second members 420, 460 may be constructed using any materials described above with respect to magnetic strips 300, 310.

Figure 26:
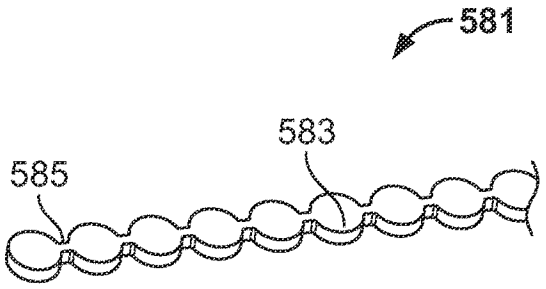
FIG. 26 illustrates a perspective view of a magnetic component of the alternate magnetic strip of FIG. 23, according to one or more aspects described herein.
Figure 23:
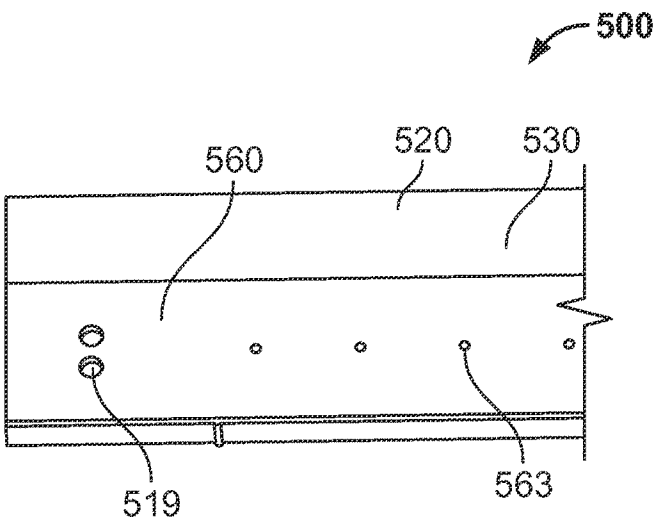
FIG. 23 illustrates a front perspective view of a portion of an alternate magnetic strip for a closure mechanism of the container of FIG. 1, according to one or more aspects described herein.
Figure 25:
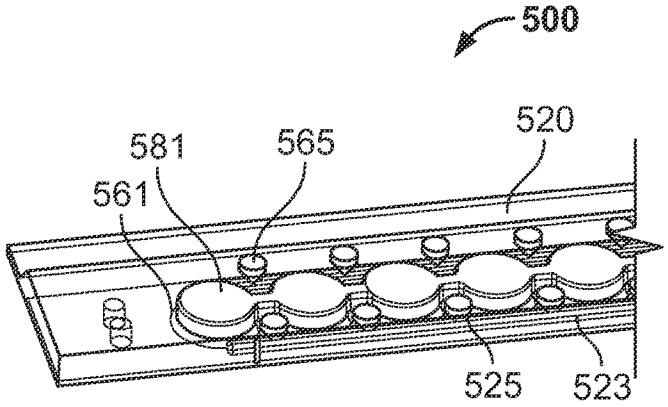
FIG. 25, illustrates a front perspective view of a portion of the alternate magnetic strip of FIG. 23 with some components removed for clarity, according to one or more aspects described herein.
Figure 28:
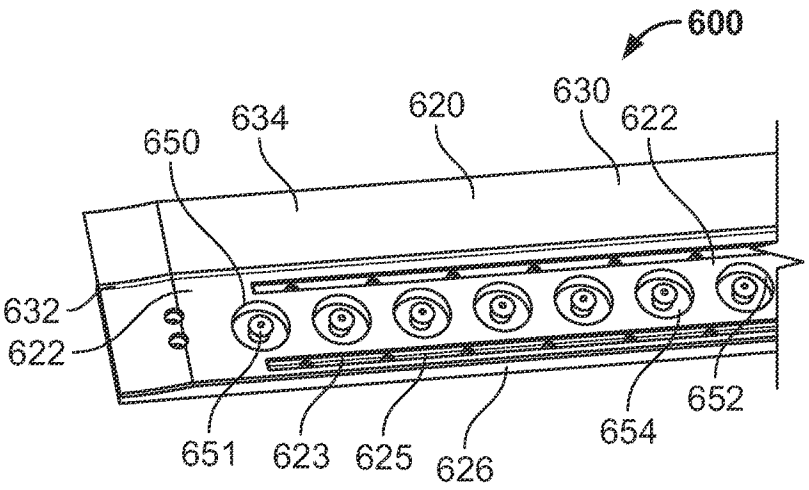
FIG. 28 illustrates a perspective view of a portion of a portion of the alternate magnetic strip of FIG. 27 with some components removed for clarity, according to one or more aspects described herein.
Figure 30:
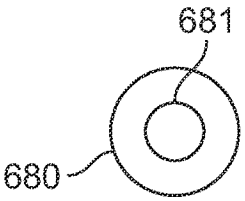
FIG. 30 illustrates a top view of a magnetic element for the magnetic strip of FIG. 27, according to one or more aspects described herein.

FIGS. 23-26 depict an alternative magnetic strip 500 that may be configured to replace magnetic strips 300 and/or 310 for closure mechanism 200 for an exemplary container 100. The magnetic strip 500 may be formed from a first member 520, a second member 560, and a magnetic element assembly 581 that forms a sleeve that is molded over a plurality of magnetic elements as shown in FIG. 26. The magnetic element assembly 581 may be formed to hold the magnetic elements within a linear orientation. The magnetic element assembly 581 may include larger regions 583 that hold each magnetic element and smaller regions 585 connecting the larger regions 583. The first member 520 may include a receiver that has a corresponding shape of the magnetic element assembly 581. For instance, the receiver may comprise a trough with larger regions that receive the corresponding larger regions 583 of the magnetic element assembly 581 and smaller regions that receive the corresponding smaller regions 585 of the magnetic element assembly 581. The first member 520 may include a front surface that includes the receiver, a rear surface 528 opposite the front surface, a top surface 524, a bottom surface 526 opposite the top surface 524, and an upper shelf member 530 that extends beyond the top surface 524.

The first member 520 may further include a channel 523 recessed within the front surface of the first member 520. In some examples, the channel 523 may include an aperture or plurality of apertures 525. These apertures 525 may be through holes. As explained below, there channels 523 and apertures 525 may assist in securing the second member 560 to the first member 520. These channels 523 and apertures 525 may be similar to the channels 423 and apertures 425 described with respect to magnetic strip 400.

The properties of the magnetic elements secured within the magnetic element assembly 581 with respect to shape and size may be the same as magnetic elements 380 discussed above. In addition, the polarity of the plurality of magnetic elements in the magnetic element assembly may have alternating polarity similar to the polarity of the plurality of magnetic elements 380 discussed above.

A second member 560 may be joined or connected to the first member 520 to cover the magnetic element assembly 581 that is within the plurality of receivers of the first member 520. The second member 560 may help to secure the magnetic element assembly 581 to the magnetic strip 500. The second member 560 may comprise a complementary receiver 561 to receive a portion of the magnetic element assembly 581. The second member 560 may also include a plurality of protrusions (not shown) that may extend into a corresponding receiver as described with respect to protrusion 366. In addition, the second member 560 may comprise a projection or projections (not shown) that extends into the channels 523 of the first member 520. Each projection may include an extension 565 that further extends into the aperture 525 and extends to the rear surface 528 of the first member 520. Each extension 565 may have a cylindrical shape with multiple diameters. For example, a second end of each extension 565 may have a larger diameter at a second end near the rear surface 528 than at the first end opposite the second end. A top surface of the second end may be coplanar with the rear surface 528 of the first member 520. This larger end at a second end may help to form interlocking geometry to further secure the second member 560 to the first member 520.

In some examples, the magnetic element assembly 581 may be formed by molding a sleeve over a linear array of magnetic elements. The magnetic element assembly 581 may be installed into a tooling member where the first member 520 is molded around at least a portion of the magnetic element assembly 581 using an injection molding process. Then, the second member 560 may be molded onto the first member 520 to further secure the cover and secure the magnetic element assembly 581 to the magnetic strip 500. Each projection and extension 565 may be formed with the second member 560 as a single unitary member. In one example, the magnetic element assembly 581 may be held in place in the tooling member using the openings 563 that are formed in the second member 560. The first and second members 520, 560 may be constructed using any materials described above with respect to magnetic strips 300, 310.

Figure 27:
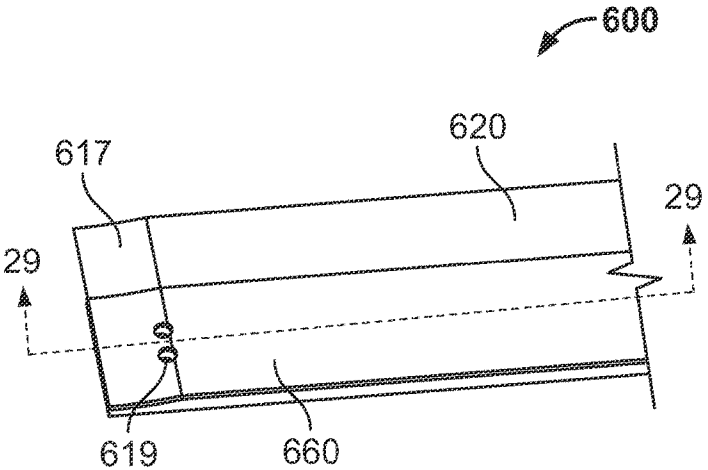
FIG. 27 illustrates a perspective view of a portion of an alternate magnetic strip for a closure mechanism of the container of FIG. 1, according to one or more aspects described herein.
Figure 29:
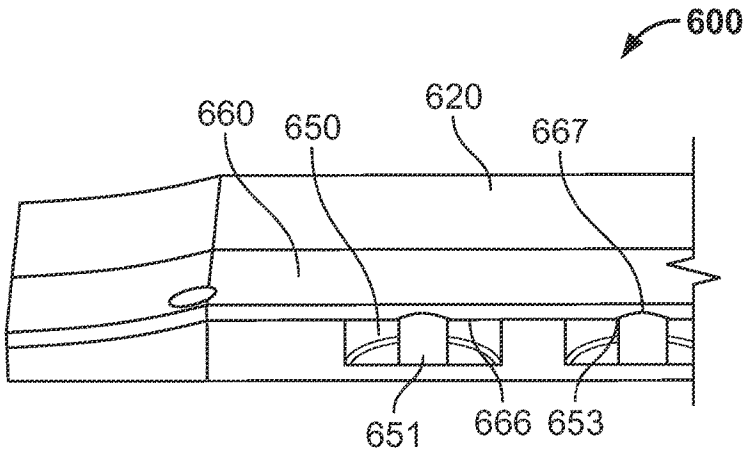
FIG. 29 illustrates a perspective cross-sectional view of the portion of the alternative magnetic strip of FIG. 27 along line 29-29, according to one or more aspects described herein.

FIGS. 27-30 depict an alternative magnetic strip 600 that may be configured to replace magnetic strips 300 and/or 310 for closure mechanism 200 for an exemplary container 100. The magnetic strip 600 may be formed from a first member 620, a second member 660, along with a plurality of magnetic elements 680. As shown in FIG. 27, magnetic strip 600 may include a tapered region 617 at either or both ends. This tapered region 617 may assist in the proper fit and/or attachment of the magnetic strips 600 and to ensure a proper seal of the closure mechanism 200. The tapered region 617 may be formed on both of the magnetic strips 600 or may only be on one of the magnetic strips. In some examples, magnetic strip 600 may not include a tapered region 617.

The first member 620 may include a plurality of receivers 650 to receive the magnetic elements 680. Each receiver 650 may include a central peg 651 that extends from a bottom surface 654 of each receiver 650, and a sidewall surface 652. Each central peg 651 may be formed as part of the first member 620 such that the central pegs 651 and the first member 620 are formed as a single unitary member. The first member 620 may include a front surface 622, a top surface, a bottom surface 626 opposite the top surface, and a rear surface opposite the front surface 622, and an upper shelf member 630 that extends beyond the top surface. The upper shelf member 630 connects to the front surface 622 forming an upper shelf surface 632 extending between the front surface 622 and a connection surface 634 of the upper shelf member 630. The plurality of receivers 650 and their corresponding magnetic elements 680 may be aligned in a linear orientation. Optionally, the receivers 650 and magnetic elements 680 may be arranged in an array with multiple rows and columns. The connection surface 634 may be spaced apart a first predetermined distance from the front surface 622.

The first member 620 may further include a channel 623 recessed within the front surface 622. In some examples, the channel 623 may include an aperture or plurality of apertures 625. These apertures 625 may be blind holes or through holes. As explained below, there channels 623 and apertures 625 may assist in securing the second member 660 to the first member 620.

Each magnetic element 680 may be individually received in a corresponding receiver 650. In addition, each magnetic element 680 may include a central opening 681 that receives the central peg 651 that is located in each receiver 650. The central opening 681 of the magnetic element 680 may be sized and shaped similarly to a cross-sectional profile of the central peg 651. Each central peg 651 may include an undercut 653. The properties of the magnetic elements 680 with respect to shape and size may be the same as magnetic elements 380 discussed above. In addition, the polarity of the plurality of magnetic elements 680 may be similar to the polarity of the plurality of magnetic elements 380 discussed above.

A second member 660 may be joined or connected to the first member 620 to cover the plurality of magnetic elements 680 that are within the plurality of receivers 650 of the first member 620. The second member 660 may help to secure the magnetic elements 680 to the magnetic strip 600. The second member 660 may comprise an upper surface that contacts the upper shelf surface 632 of the first member 620 and a front surface that contacts the front surface 622. In addition, the second member 660 may comprise a plurality of protrusions 666, where each protrusion 666 is arranged to contact a magnetic element 680 and where each protrusion 666 has a shape that is complementary to each receiver 650 and also includes a pocket 667 that receives an upper end of each central peg 651. Each protrusion 666 may extend into a corresponding receiver 650 as described above with respect to protrusion 366. Additionally, the second member 660 may include a projection or projections (not shown) that extend into the channels 623 of the first member 620. Each projection may include an extension that further extends into the aperture 625. The projections and the protrusions 666 help to form interlocking geometry to further secure the second member 660 to the first member 620.

In some examples, the magnetic strips 600 may be formed using an injection molding process with the magnetic elements 680 installed in a step after molding the first member 620 and before molding the second member 660. For example, the first member 620 may be molded, then each of the magnetic elements 680 may be installed into each corresponding receiver 650 and receiving a corresponding central peg 651 in the central opening 681 of each magnetic element 680. Once the magnetic elements 680 are positioned in their corresponding receivers 650, the second member 660 may be molded onto the first member 620 to cover and secure the magnetic elements 680 to the magnetic strip 600. The first and second members 620, 660 may be constructed using any materials described above with respect to magnetic strips 300, 310.

Figure 32:
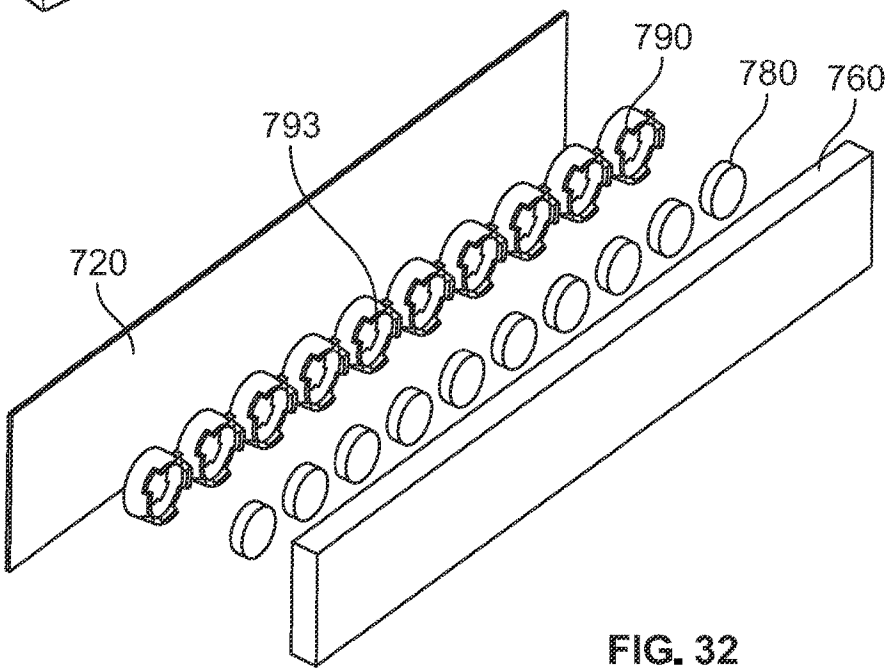
FIG. 32 illustrates a rear-facing, exploded perspective view of a portion of an alternative magnetic strip for a closure mechanism of the container of FIG. 1, according to one or more aspects described herein.
Figure 31:
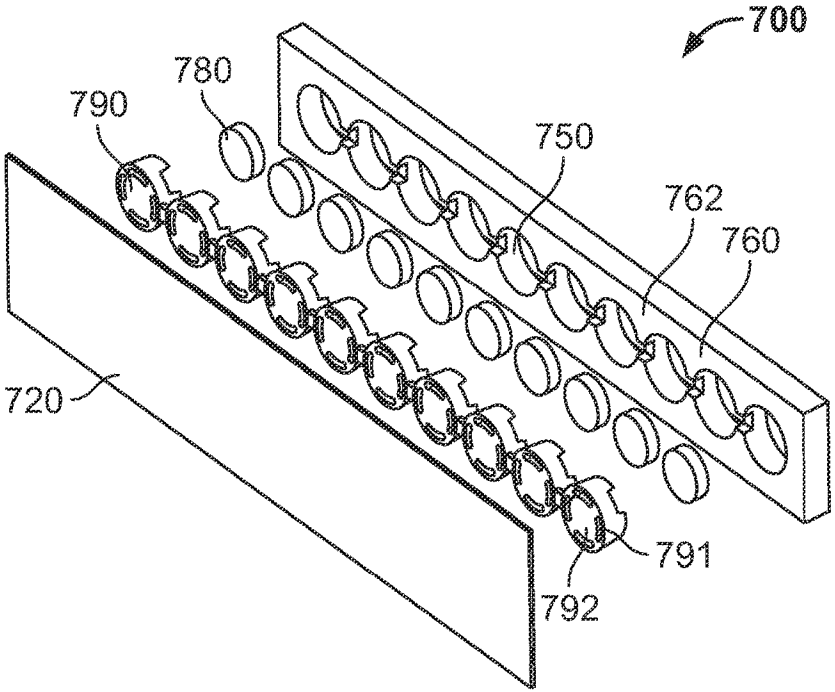
FIG. 31 illustrates a front-facing, exploded perspective view of a portion of an alternative magnetic strip for a closure mechanism of the container of FIG. 1, according to one or more aspects described herein.

FIGS. 31-32 depict exploded views of an alternative magnetic strip 700 that may be configured to replace magnetic strips 300 and/or 310 for closure mechanism 200 for an exemplary container 100. The magnetic strip 700 may be formed from a first member 720, a second member 760, a plurality of magnetic elements 780, and a plurality of covers 790. Each magnetic element 780 may be individually received within a corresponding magnetic cover 790 and may be secured to the magnetic cover 790 using an adhesive, friction fit, joining, welding, heat pressing, or other means known to one skilled in the art. The magnetic covers 790 may then be attached to the first member 720 such as by an adhesive, radio-frequency welding, or other method known to one skilled in the art. In some examples, the plurality of magnetic covers 790 may be formed as a single unitary member that has individual pockets to receive each magnetic element 780. Once the magnetic covers 790 with the magnetic elements 780 is secured to the first member 720, the second member 760 may be joined or connected to the first member 720 to cover the magnetic covers 790 and fully secure each magnetic element 780 within each magnetic cover 790. The second member 760 may have a plurality of receivers 750 in a front surface 762 that receive each magnetic cover 790.

In some examples, each magnetic cover 790 may include a slot 791 or plurality of slots that extend through a rear surface 792 of the magnetic cover 790. In addition, each magnetic cover 790 may include a stepped front surface such that the front surface has a plurality of steps 793. Additionally, the second member 760 may be formed onto the first member 720, the magnetic covers 790, and the magnetic elements 780, such that the second member 760 is formed using injection molding and the receivers 750 have corresponding surfaces to the steps 793 on the front surface of the magnetic covers 790 and may also have extensions that extend through the slot or slots 791 of the magnetic covers. The first member 720, the magnetic cover 790, and the second member 760 may be may be constructed using any materials described above with respect to magnetic strips 300, 310.

The present disclosure is disclosed above and in the accompanying drawings with reference to a variety of examples. The various examples described herein may have features can be combined to form another exemplary magnetic strip. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

We claim:

1. A container, comprising:

an outer shell defining a sidewall and a base, the outer shell having a front portion, a back portion, side portions, and a base portion;

an opening extending into a storage compartment, the opening having a front side and a back side;

a closure mechanism, further comprising:

a first magnetic strip coupled to the front portion at the front side of the opening comprising:

a first non-metallic member with a first plurality of receivers in a first front surface, wherein each receiver includes a sidewall surface, a bottom surface, the first non-metallic member further including a first top surface, a first bottom surface opposite the first top surface, a first rear surface opposite the first front surface, and a first upper shelf member that extends beyond the first top surface, wherein the first upper shelf member connects to the first front surface forming an upper shelf surface extending between the first front surface of the first non-metallic member and a connection surface of the first upper shelf member, wherein the connection surface is spaced apart a first predetermined distance from the first front surface;

a first plurality of magnetic elements, wherein each magnetic element of the first plurality of magnetic elements is received in a corresponding receiver of the first plurality of receivers;

a second non-metallic member joined to the first non-metallic member, wherein the second non-metallic member covers the first plurality of magnetic elements that are within the first plurality of receivers of the first non-metallic member;

the second non-metallic member further comprising an upper surface that contacts the upper shelf surface of the first non-metallic member, a second front surface that contacts the first front surface of the first non-metallic member, and a second rear surface opposite the second front surface of the second non-metallic member that is substantially coplanar with the connection surface of the first upper shelf member of the first non-metallic member; and a second magnetic strip coupled to the back portion at the back side of the opening comprising:

a third non-metallic member with a second plurality of receivers in a third front surface and a third rear surface opposite the third front surface;

a second plurality of magnetic elements, wherein each magnetic element of the second plurality of magnetic elements is received in a corresponding receiver of the second plurality of receivers;

a fourth non-metallic member that covers the second plurality of magnetic elements that are within the second plurality of receivers of the third non-metallic member;

the fourth non-metallic member further comprising a fourth front surface that contacts the third front surface of the third non-metallic member; and wherein when the closure mechanism is in a closed configuration, the first rear surface of the first non-metallic member contacts the third rear surface of the third non-metallic member.

2. The container of claim 1, wherein the first plurality of receivers is aligned in a linear orientation.

3. The container of claim 1, wherein each receiver of the first plurality of receivers includes a slot along the sidewall surface, wherein the slot extends from the bottom surface to the first front surface.

4. The container of claim 1, wherein the first non-metallic member includes a lower shelf member, wherein a first engaging surface of the lower shelf member is spaced apart a second predetermined distance from the first front surface, wherein the first engaging surface is spaced below the first front surface and below the connection surface.

5. The container of claim 4, wherein the first non-metallic member further comprises a lower shelf surface formed between the first front surface and the first engaging surface, wherein the lower shelf surface includes a plurality of recesses that extend toward the upper shelf surface, wherein a peak of a first recess of the plurality of recesses is located in between two receivers of the first plurality of receivers.

6. The container of claim 5, wherein the second non-metallic member further comprises a second engaging surface that contacts the lower shelf surface of the first non-metallic member, wherein the second engaging surface includes a first projection that extends into the first recess, wherein the first projection and the first recess have corresponding surfaces that fit together.

7. The container of claim 1, wherein an upper surface of each magnetic element is spaced a third predetermined distance below the first front surface of the first non-metallic member.

8. The container of claim 6, wherein the second non-metallic member further includes a plurality of protrusions that extend from the second front surface of the second non-metallic member, and wherein each protrusion of the plurality of protrusions extends into a corresponding receiver of the first plurality of receivers, and wherein a portion of each protrusion of the plurality of protrusions contacts a corresponding magnetic element of the first plurality of magnetic elements located in the corresponding receiver.

9. The container of claim 1, wherein a portion of the connection surface of the first non-metallic member connects to the front side of the opening.

10. A closure mechanism for an opening of a container, comprising:

a first magnetic strip coupled to a first side of the opening comprising:

a first non-metallic member with a first plurality of receivers in a first front surface, wherein each receiver includes a sidewall surface, a bottom surface, and the first non-metallic member further including a first top surface, a first bottom surface opposite the first top surface, and a first rear surface opposite the first front surface;

a first plurality of magnetic elements, wherein each magnetic element of the first plurality of magnetic elements is received in a corresponding receiver of the first plurality of receivers, and wherein an upper surface of each magnetic element of the first plurality of magnetic elements is spaced a first predetermined distance below the first front surface of the first non-metallic member;

a second non-metallic member joined to the first non-metallic member, wherein the second non-metallic member covers the first plurality of magnetic elements that are within the first plurality of receivers of the first non-metallic member;

the second non-metallic member further comprising a second front surface that contacts the first front surface of the first non-metallic member, a second rear surface opposite the second front surface of the second non-metallic member, and a plurality of protrusions that extend from the second front surface of the second non-metallic member, and wherein each protrusion of the plurality of protrusions extends into a corresponding receiver of the first plurality of receivers; and a second magnetic strip coupled to a second side of the opening comprising:

a third non-metallic member with a second plurality of receivers in a third front surface and a third rear surface opposite the third front surface;

a second plurality of magnetic elements, wherein each magnetic element of the second plurality of magnetic elements is received in a corresponding receiver of the second plurality of receivers;

a fourth non-metallic member that covers the second plurality of magnetic elements that are within the second plurality of receivers of the third non-metallic member;

the fourth non-metallic member further comprising a fourth front surface that contacts the third front surface of the third non-metallic member; and wherein when the closure mechanism is in a closed configuration, the first rear surface of the first non-metallic member contacts the third rear surface of the third non-metallic member.

11. The closure mechanism of claim 10, wherein a portion of each protrusion of the plurality of protrusions contacts a corresponding magnetic element of the first plurality of magnetic elements located in the corresponding receiver.

12. The closure mechanism of claim 10, wherein each receiver of the first plurality of receivers includes a slot along the sidewall surface, wherein the slot extends from the bottom surface to the first front surface.

13. The closure mechanism of claim 10, wherein the first non-metallic member includes the first non-metallic member further including a lower shelf member, wherein a first engaging surface of the lower shelf member is spaced apart a second predetermined distance from the first front surface, wherein the first engaging surface is spaced below the first front surface.

14. The closure mechanism of claim 13, wherein the first non-metallic member further comprises a lower shelf surface formed between the first front surface and the first engaging surface, wherein the lower shelf surface includes a plurality of recesses that extend toward the first top surface, wherein a peak of a first recess of the plurality of recesses is located in between two receivers of the first plurality of receivers.

15. The closure mechanism of claim 14, wherein the second non-metallic member further comprises a second engaging surface that contacts the lower shelf surface of the first non-metallic member, wherein the second engaging surface includes a first projection that extends into the first recess, wherein the first projection and the first recess have corresponding surfaces that fit together.

16. A container, comprising:

an outer shell defining a sidewall and a base, the outer shell having a front portion, a back portion, side portions, and a base portion;

an opening extending into a storage compartment, the opening having a front side and a back side;

a closure mechanism, further comprising:

a first magnetic strip coupled to the front portion at the front side of the opening comprising:

a first member with a first plurality of receivers in a first front surface, wherein each receiver includes a sidewall surface, a bottom surface, and the first member further including a first top surface, a first bottom surface opposite the first top surface, a first rear surface opposite the first front surface, and a first lower shelf member, wherein a first engaging surface of the first lower shelf member is spaced a first predetermined distance away from and below the first front surface;

wherein the first member further comprises a lower shelf surface formed between the first front surface and the first engaging surface, wherein the lower shelf surface includes a plurality of recesses that extend toward the first top surface, wherein a peak of a first recess of the plurality of recesses is located in between two receivers of the first plurality of receivers;

a first plurality of magnetic elements, wherein each magnetic element of the first plurality of magnetic elements is received in a corresponding receiver of the first plurality of receivers; and a second member joined to the first member, wherein the second member covers the first plurality of magnetic elements that are within the first plurality of receivers of the first member;

the second member further comprising a second front surface that contacts the first front surface of the first member, a second rear surface opposite the second front surface of the second member; and a second magnetic strip coupled to the back portion at the back side of the opening comprising:

a third member with a second plurality of receivers in a third front surface and a third rear surface opposite the third front surface;

a second plurality of magnetic elements, wherein each magnetic element of the second plurality of magnetic elements is received in a corresponding receiver of the second plurality of receivers;

a fourth member that covers the second plurality of magnetic elements that are within the second plurality of receivers of the third member;

the fourth member further comprising a fourth front surface that contacts the third front surface of the third member; and wherein when the closure mechanism is in a closed configuration, the first rear surface of the first member contacts the third rear surface of the third member.

17. The container of claim 16, wherein the second member further comprises a second engaging surface that contacts the lower shelf surface of the first member, wherein the second engaging surface includes a first projection that extends into the first recess, wherein the first projection and the first recess have corresponding surfaces that fit together.

18. The container of claim 16, wherein an upper surface of each magnetic element is spaced a third predetermined distance below the first front surface of the first member.

19. The container of claim 18, wherein the second member further includes a plurality of protrusions that extend from the second front surface of the second member, and wherein each protrusion of the plurality of protrusions extends into a corresponding receiver of the first plurality of receivers.

20. The container of claim 19, wherein a portion of each protrusion of the plurality of protrusions contacts a corresponding magnetic element of the first plurality of magnetic elements located in the corresponding receiver.

* * * * *